US007567229B2

(12) United States Patent
Kasai et al.

(10) Patent No.: US 7,567,229 B2
(45) Date of Patent: Jul. 28, 2009

(54) ELECTRO-OPTICAL DEVICE, METHOD OF DRIVING ELECTRO-OPTICAL DEVICE, AND ELECTRONIC APPARATUS

(75) Inventors: Toshiyuki Kasai, Okaya (JP); Yoichi Imamura, Chino (JP)

(73) Assignee: Seiko Epson Corporation, Tokyo (JP)

( * ) Notice: Subject to any disclaimer, the term of this patent is extended or adjusted under 35 U.S.C. 154(b) by 593 days.

(21) Appl. No.: 10/849,834

(22) Filed: May 21, 2004

(65) Prior Publication Data

US 2005/0007392 A1 Jan. 13, 2005

(30) Foreign Application Priority Data

May 28, 2003 (JP) ..... 2003-151294

(51) Int. Cl.
*G09G 3/36* (2006.01)

(52) U.S. Cl. ..... 345/89; 345/690

(58) Field of Classification Search ..... 345/690, 345/204, 89

See application file for complete search history.

(56) References Cited

U.S. PATENT DOCUMENTS

| | | | | |
|---|---|---|---|---|
| 5,642,172 | A | 6/1997 | Yoon et al. | |
| 6,256,006 | B1 * | 7/2001 | Yamamoto et al. | 345/101 |
| 6,320,568 | B1 * | 11/2001 | Zavracky | 345/101 |
| 6,700,559 | B1 * | 3/2004 | Tanaka et al. | 345/88 |
| 6,778,159 | B1 * | 8/2004 | Yamazaki et al. | 345/89 |
| 6,943,836 | B2 | 9/2005 | Kitagawa | |
| 6,961,037 | B2 | 11/2005 | Kuwata et al. | |
| 7,071,635 | B2 | 7/2006 | Inoue et al. | |
| 2001/0055007 | A1 | 12/2001 | Miura et al. | |
| 2003/0011538 | A1 * | 1/2003 | Lys et al. | 345/39 |
| 2003/0071804 | A1 * | 4/2003 | Yamazaki et al. | 345/204 |
| 2005/0030264 | A1 | 2/2005 | Tsuge et al. | |
| 2005/0041002 | A1 | 2/2005 | Takahara et al. | |
| 2005/0057580 | A1 | 3/2005 | Yamano et al. | |
| 2007/0146251 | A1 | 6/2007 | Tsuge et al. | |

FOREIGN PATENT DOCUMENTS

| | | |
|---|---|---|
| CN | 1119397 A | 3/1996 |
| CN | 1326306 A | 12/2001 |
| JP | A-03-036519 | 2/1991 |
| JP | A-11-327508 | 11/1999 |
| JP | A-2000-112429 | 4/2000 |
| JP | A-2000-122598 | 4/2000 |

(Continued)

OTHER PUBLICATIONS

Wikipedia, "Color Temperature", pp. 1-5, Printed May 11, 2007.

*Primary Examiner*—Amr Awad
*Assistant Examiner*—Yong Sim
(74) *Attorney, Agent, or Firm*—Oliff & Berridge PLC

(57) ABSTRACT

The invention provides an electro-optical device that stabilizes display quality by performing correction processing corresponding to a plurality of disturbance factors. Specifically, a grayscale characteristic generating unit can generate conversion data having grayscale characteristics obtained by changing the grayscale characteristics of display data that defines the grayscales of pixels with reference to a conversion table whose description contents include correction factors. A data line driving circuit can drive the pixels after correcting the grayscale characteristics of the conversion data by the correction factors using other processing different from the that performed by the grayscale characteristic generating unit.

29 Claims, 17 Drawing Sheets

FOREIGN PATENT DOCUMENTS

| | | | |
|---|---|---|---|
| JP | A-2001-028697 | | 1/2001 |
| JP | A-2001-290174 | | 10/2001 |
| JP | A-2002-165111 | | 6/2002 |
| JP | A 2002-175046 | | 6/2002 |
| JP | A-2002-287683 | | 10/2002 |
| JP | A-2002-297096 | | 10/2002 |
| WO | WO 03/012771 | A2 | 2/2003 |
| WO | WO 03/027998 | A1 | 4/2003 |
| WO | WO 03/027999 | A1 | 4/2003 |

* cited by examiner

| DATA D | LUT1 (FOUR GRAYSCALES) | LUT2 (EIGHT GRAYSCALES) | LUT3 (TWELVE GRAYSCALES) | LUT4 (SIXTEEN GRAYSCALES) |
|---|---|---|---|---|
| 0000 | 000000 | 000000 | 000000 | 000000 |
| 0001 | 000000 | 000000 | 000001 | 000001 |
| 0010 | 000000 | 000001 | 000001 | 000010 |
| 0011 | 000000 | 000001 | 000010 | 000101 |
| 0100 | 000001 | 000010 | 000101 | 001000 |
| 0101 | 000001 | 000010 | 000001 | 001011 |
| 0110 | 000001 | 000100 | 001000 | 001111 |
| 0111 | 000001 | 000100 | 001000 | 010011 |
| 1000 | 000010 | 000110 | 001011 | 011000 |
| 1001 | 000010 | 000110 | 001110 | 011100 |
| 1010 | 000010 | 001001 | 010010 | 100001 |
| 1011 | 000010 | 001001 | 010110 | 100111 |
| 1100 | 000100 | 001100 | 011011 | 101100 |
| 1101 | 000100 | 001100 | 011111 | 110010 |
| 1110 | 000100 | 001111 | 011111 | 111000 |
| 1111 | 000100 | 001111 | 100100 | 111111 |

| Dcvt (6bit) | K | | Damd (8bit) |
|---|---|---|---|
| | a | b | |
| 000000 | 010 | 110 | 00000110 |
| 000001 | | | 00001000 |
| 000010 | | | 00001010 |
| 000101 | | | 00010000 |
| 001000 | | | 00010110 |
| 001011 | | | 00011100 |
| 001111 | | | 00100100 |
| 010011 | | | 00101100 |
| 011000 | | | 00110110 |
| 011100 | | | 00111110 |
| 100001 | | | 01001000 |
| 100111 | | | 01010100 |
| 101100 | | | 01011110 |
| 110010 | | | 01101010 |
| 111000 | | | 01110110 |
| 111111 | | | 10000100 |

FIG.15

ELECTRO-OPTICAL DEVICE, METHOD OF DRIVING ELECTRO-OPTICAL DEVICE, AND ELECTRONIC APPARATUS

BACKGROUND OF THE INVENTION

1. Field of Invention

The present invention relates to an electro-optical device, a method of driving the electro-optical device, and an electronic apparatus, and more particularly, to processing of correcting display data for defining grayscales of a pixel.

2. Description of Related Art

Conventionally, electro-optical devices having a correcting function in order to suppress the deterioration of display quality due to disturbance factors are known. For example, a technology for detecting changes in temperature accompanied by heat generation of organic EL elements by a plurality of temperature sensors provided in a display panel and correcting the driving of the display panel in accordance with the detected change is disclosed in Japanese Unexamined Patent Application Publication No. 2002-175046.

SUMMARY OF THE INVENTION

However, there are various disturbance factors, other than the above-mentioned temperature factor, that affect the display quality, for example, ambient luminance during the use of the electro-optical device, the deterioration over time of the electro-optical elements included in the pixels, and non-uniformity of display due to differences in the manufacturing of the display panels.

It is an object of the invention to stabilize display quality by performing correction processing corresponding to the plurality of disturbance factors.

It is another object of the invention to increase the speed of the correction processing.

The invention can provide an electro-optical device, having a grayscale characteristic generating unit for generating conversion data having grayscale characteristics obtained by changing the grayscale characteristics of display data from the display data defining the grayscales of pixels with reference to a conversion table in which a correspondence relationship between input display data and output conversion data is described and at least one first correction factor is included in the described table contents, and a pixel-driving unit for driving the pixels after correcting the grayscale characteristics of the conversion data by at least one second correction factor different from the first correction factor using processing different from that of the grayscale characteristic generating unit. In the invention, it is preferable that the pixel-driving unit corrects the grayscale characteristics of the conversion data on a level finer than changes in the grayscale characteristics of the display data by the grayscale characteristic generating unit.

The invention can also provide an electro-optical device, having a grayscale characteristic generating unit for generating conversion data obtained by roughly adjusting the grayscale characteristics of display data defining the grayscales of pixels with reference to a conversion table in which a correspondence relationship between input display data and output conversion data is described and at least one first correction factor is included in the described table contents; and a pixel-driving unit for driving the pixels after finely adjusting the grayscale characteristics of the conversion data on a level finer than the rough adjustment on the basis of at least one second correction factor being different from the first correction factor.

In the invention, it is preferable that the grayscale characteristic generating unit includes a plurality of the conversion tables whose description contents are different from each other, and selects any one of the plurality of conversion tables as a subject of reference in accordance with the first correction factor.

In the invention, the pixel-driving unit may include a grayscale correcting unit for generating correction data by correcting the conversion data on the basis of the second correction factor, and a data signal generating unit for generating data signals supplied to the pixels on the basis of the correction data. In this case, it is preferable that the grayscale correcting unit generates the correction data by a logic operation between the conversion data and the second correction factor. Further, as another structure, the pixel-driving unit may include a data signal generating unit for generating data signals supplied to the pixels on the basis of the conversion data, and the data signal generating unit may analog correct the data signals on the basis of the second correction factor. Moreover, as another structure, the pixel-driving unit may include a data signal generating unit for generating data signals supplied to the pixels on the basis of the conversion data, and a driving period controlling unit for variably controlling a driving period in which the brightness of electro-optical elements included in the pixels is set on the basis of the second correction factor. In the above structures, it is preferable that when the pixels have electro-optical elements whose brightness is set by the current that flows through the pixels, and the data signal generating unit generates the data signals on the basis of current.

In the invention, it is preferable that the first correction factor comprises an ambient illuminance change of the electro-optical device and/or a self-heating temperature change of the electro-optical elements included in the pixels. In this case, the electro-optical device may further have an illuminance-detecting unit for detecting the ambient illuminance of the electro-optical device, and the ambient illuminance change may be calculated on the basis of the ambient illuminance detected by the illuminance-detecting unit.

In the invention, it is preferable that the second correction factor comprises the ambient temperature change of the electro-optical device and/or the deterioration change of the electro-optical elements included in the pixels and/or the display non-uniformity of the display unit in which the pixels are arranged in a matrix. In this case, the electro-optical device may further include a temperature-detecting unit for detecting the ambient temperature of the electro-optical device, and the ambient temperature change is calculated on the basis of the ambient temperature detected by the temperature-detecting unit. Further, the electro-optical device may further comprises a deterioration degree detecting unit for detecting the degree of deterioration of the electro-optical elements included in the pixels, and the deterioration change is calculated on the basis of the degree of deterioration detected by the deterioration degree detecting unit. Further, it is preferable that, when a plurality of the second correction factors exist, the pixel-driving unit comprises a correction value generating unit for calculating a correction value on the basis of the plurality of second correction factors and drives the pixels on the basis of the correction value calculated by the correction value generating unit. It is desirable that the correction value generating unit calculates the correction value by logic operations of the plurality of second correction factors.

The invention can also provide an electro-optical device, having a grayscale characteristic generating unit for generating conversion data having grayscale characteristics obtained by changing the grayscale characteristics of display data from the display data defining the grayscales of pixels with reference to a conversion table in which a correspondence relationship between input display data and output conversion data is described and a self-heating temperature change of the electro-optical elements included in the pixels is included in the described table contents thereof, and a pixel-driving unit for driving the pixels on the basis of the conversion data.

The fourth invention provides an electronic apparatus in which the electro-optical device according to any one of the above inventions is mounted.

The invention can further provide a method of driving an electro-optical device, having a first step of generating conversion data having grayscale characteristics obtained by changing the grayscale characteristics of display data from the display data defining the grayscales of pixels with reference to a conversion table in which a correspondence relationship between input display data and output conversion data is described and at least one first correction factor is included in the described table contents; and a second step of driving the pixels after correcting the grayscale characteristics of the conversion data by at least one second correction factor different from the first correction factor using processing different from that of the first step. In the invention, it is preferable that the second step includes a step of correcting the grayscale characteristics of the conversion data on a level finer than changes in the grayscale characteristics of the display data in the first step.

The invention can also provide a method of driving an electro-optical device, having a first step of generating conversion data obtained by roughly adjusting the grayscale characteristics of display data defining the grayscales of pixels with reference to a conversion table in which a correspondence relationship between input display data and output conversion data is described and at least one first correction factor is included in the described table contents, and a second step for driving the pixels after finely adjusting the grayscale characteristics of the conversion data on a level finer than the rough adjustment on the basis of at least one second correction factor being different from the first correction factor.

In the above invention, it is preferable that the first step includes a step of selecting any one of a plurality of the conversion tables whose description contents are different from each other as a subject of reference in accordance with the first correction factor.

In the invention, it is preferable that the second step includes a step of generating correction data by correcting the conversion data on the basis of the second correction factor, and a step of generating data signals supplied to the pixels on the basis of the correction data. Herein, the step of generating the correction data may be a step of generating the correction data by a logic operation between the conversion data and the second correction factor. Further, instead of this, the second step is a step of generating data signals supplied to the pixels on the basis of the conversion data, and analog correcting the data signals on the basis of the second correction factor. Moreover, instead of this, the second step may can include a step of generating data signals supplied to the pixels on the basis of the conversion data, and a step of variably controlling a driving period in which the brightness of the electro-optical elements included in the pixels is set on the basis of the second correction factor. Further, it is preferable that, when the pixels comprise electro-optical elements whose brightness is set by the current that flows through the electro-optical elements, the step of generating the data signals is a step of generating the data signals on the basis of current.

In the invention, the first correction factor can include an ambient illuminance change of the electro-optical device and/or a self-heating temperature change of the electro-optical elements included in the pixels. In this case, it is preferable that the ambient illuminance change is calculated on the basis of the ambient illuminance of the electro-optical device detected by an illuminance-detecting unit.

In the invention, it is preferable that the second correction factor includes the ambient temperature change of the electro-optical device and/or the deterioration change of the electro-optical elements included in the pixels and/or the display non-uniformity of the display unit in which the pixels are arranged in a matrix. In this case, the ambient temperature change may be calculated on the basis of the ambient temperature of the electro-optical device detected by a temperature-detecting unit. Further, the deterioration change is calculated on the basis of the degree of deterioration of the electro-optical elements included in the pixels detected by a deterioration degree detecting unit. Moreover, it is preferable that, when a plurality of the second correction factors exist, the second step includes a step of calculating a correction value on the basis of the plurality of second correction factors, and a step of driving the pixels on the basis of the correction value. In this case, the correction value may be calculated by logic operations of the plurality of second correction factors in the step of calculating the correction value.

The invention provides a method of driving an electro-optical device, having a first step of generating conversion data having grayscale characteristics obtained by changing the grayscale characteristics of display data from the display data defining the grayscales of pixels with reference to a conversion table in which a correspondence relationship between input display data and output conversion data is described and a self-heating temperature change of the electro-optical elements included in the pixels is included in the described table contents thereof; and a second step of driving the pixels on the basis of the conversion data.

BRIEF DESCRIPTION OF THE DRAWINGS

This invention will be described with reference to the accompanying drawings, wherein like numerals reference like elements, and wherein:

FIG. 15 is a view illustrating the relationship between the conversion data and correction data;

DETAILED DESCRIPTION OF PREFERRED EMBODIMENTS

Figure 1:
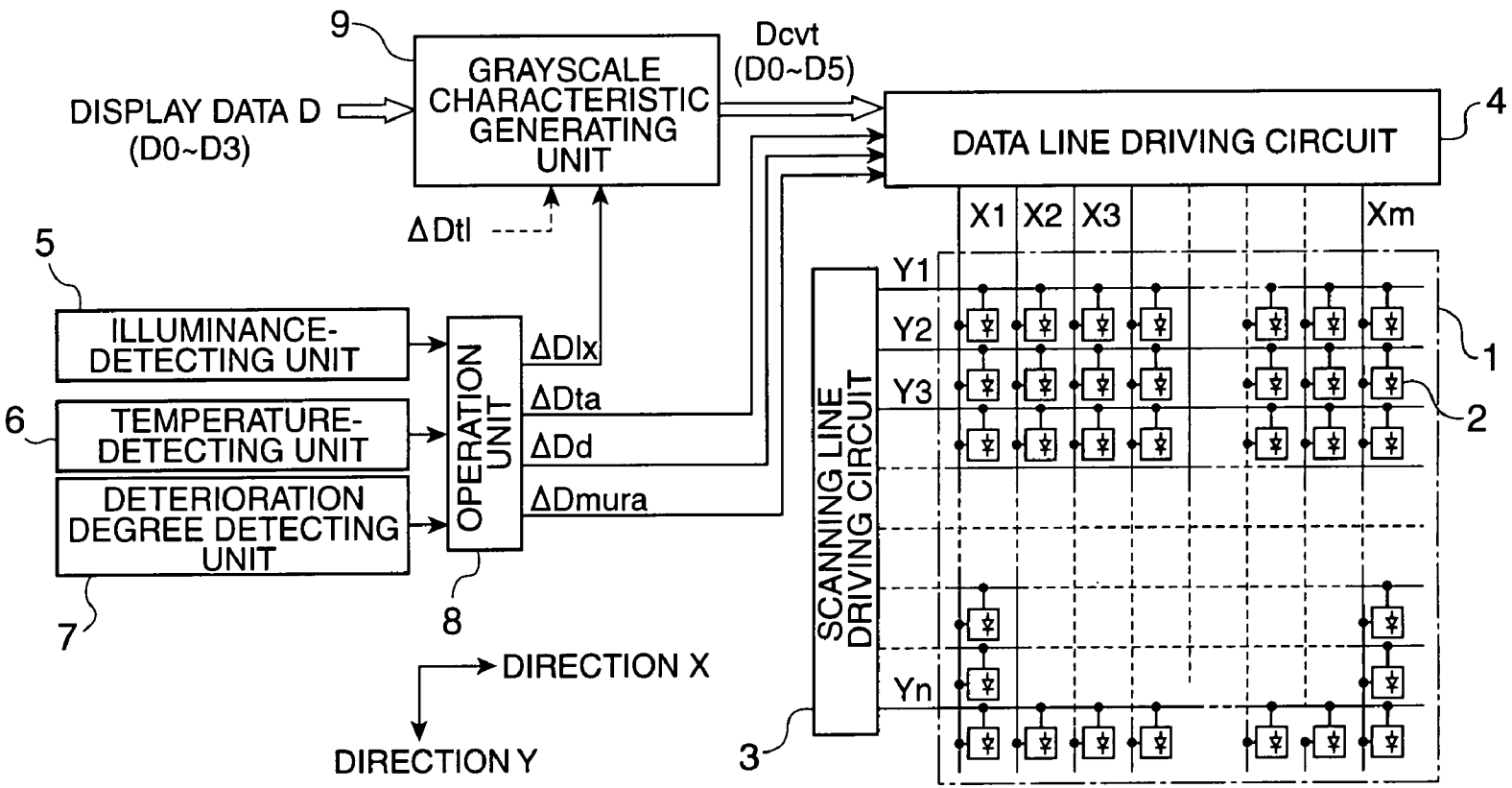
FIG. 1 is an exemplary block diagram of an electro-optical device.

FIG. 1 is an exemplary block diagram of an electro-optical device according to the present embodiment. A display unit 1 is, for example, an active matrix display panel for driving electro-optical elements by driving elements such as TFTs. In the display unit 1, pixels 2 of m dots×n lines are aligned in a matrix (in plan view). Also, in the display unit 1, a group of horizontally extending scanning lines Yl to Yn and a group of vertically extending data lines Xl to Xm are provided, and the pixels 2 are arranged to correspond the intersections thereof. In the embodiment, one pixel 2 is the minimum display unit of an image. However, as in a color panel, one pixel 2 may include three sub pixels of RGB. Also, in FIG. 1, power source lines for supplying predetermined voltages Vdd and Vss to each pixel 2 are omitted.

Figure 2:
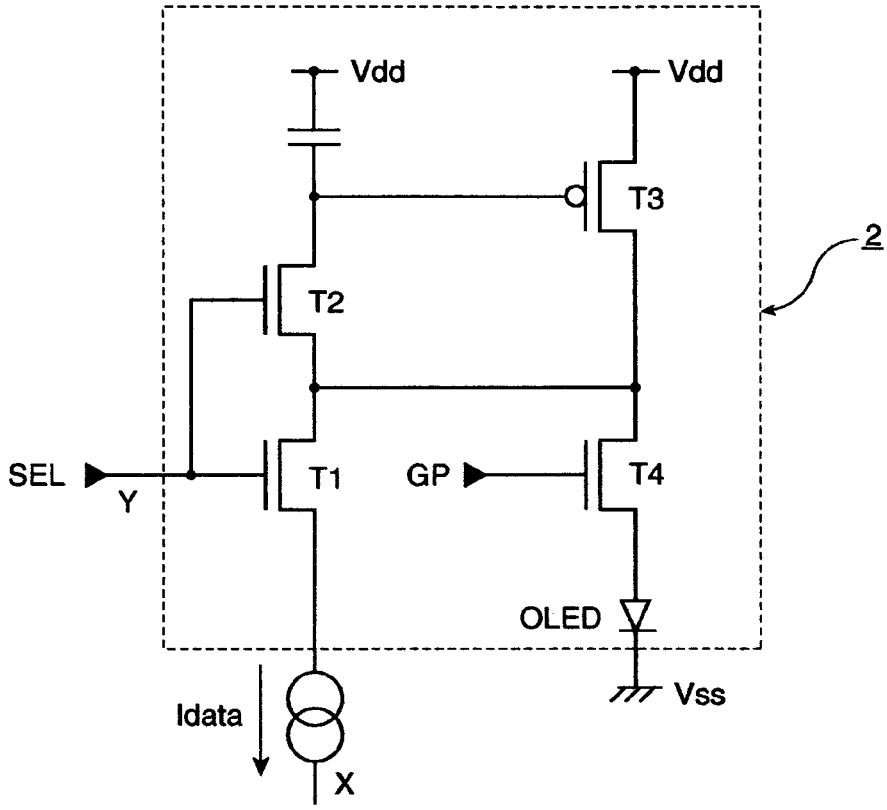
FIG. 2 is an exemplary circuit diagram of a pixel.

FIG. 2 is an exemplary circuit diagram of the pixel 2, as an example. One pixel 2 can include an organic EL element OLED, four transistors T1 to T4, and a capacitor C for holding data. The organic EL element OLED that is a diode is a typical current driving element whose brightness is set by a driving current Ioled that flows through the same. On the pixel circuit, n channel type transistors T1, T2, and T4 and a p channel type transistor T3 are used. However, this is only an example, and a channel type transistor can be set by a composition different from the above example.

The gate of the transistor T1 is connected to one scanning line Y to which a scanning signal SEL is supplied. The source of the transistor is connected to one data lines X to which the data current Idata is supplied. The drain of the transistor T1 is commonly connected to the source of the transistor T2, the drain of the transistor T3, and the drain of the transistor T4. The gate of the transistor t2 is connected to the scanning line Y, to which the scanning signal SEL is supplied as with the transistor T1. The drain of the transistor T2 is commonly connected to one electrode of a capacitor C and the gate of the transistor T3.

A power supply voltage Vdd is applied to the other electrode of the capacitor C and the source of the transistor T3. In the case of the color panel, the power supply voltage Vdd is commonly set to have different values in RGB. This is because the materials of the organic EL element OLED in RGB are different from each other, which causes a difference in electric characteristics.

The transistor T4 to whose gate a driving signal GP is supplied is provided between the drain of the transistor T3 and the anode of the organic EL element OLED. A reference voltage Vss lower than the power supply voltage Vdd is applied to the cathode of the organic EL element OLED. A memory other than the capacitor C, such as an SRAM capable of storing a large amount of data can be used as a circuit element that holds data.

Figure 3:
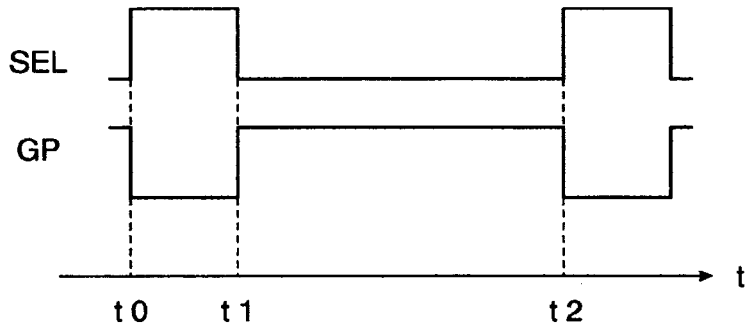
FIG. 3 is an exemplary driving timing chart of a pixel.

FIG. 3 is a driving timing chart of the pixel 2 illustrated in FIG. 2. The timing at which the selection of a certain pixel 2 starts by the line-sequential scanning of the scanning lines Yl to Yn is t0. The timing at which the selection of the pixel 2 starts again is t2. The period t0 to t2 is divided into the first half of programming period t0 to t1 and the second half of driving period t1 to t2.

Data on the capacitor C is written in the programming period t0 to t1. First, at the timing to, the scanning signal SEL rises to a high level (hereinafter an H level) and the transistors T1 and T2 that function as switching elements are turned on (conducted). Therefore, the data lines X are electrically connected to the drain of the transistor T3, and the transistor t3 is diode connected, which means the gate thereof is electrically connected to the drain thereof. The transistor T3 flows the data current Idata supplied to the data lines X to the channel thereof, and generates a voltage in response to the data current Idata as a gate voltage Vg. Charges in response to the generated gate voltage Vg accumulate in the capacitor C connected to the gate of the transistor T3 so that data corresponding to the amount of accumulated charges is written.

In the programming period t0 to t1, the transistor T3 functions as a programming transistor for writing data in the capacitor C on the basis of the data signal that flows through the channel thereof. Since the driving signal GP is maintained at a low level (hereinafter an L level), the transistor t4 is turned off (non-conducted). Therefore, the path of the driving current Ioled for the organic EL element OLED is intercepted by the transistor T4. As a result, the organic EL element OLED does not emit light.

In the subsequent driving period t1 to t2, the driving current Ioled flows through the organic EL element OLED so that the brightness of the organic EL element OLED is set. First, at the timing t1, the scanning signal SEL falls to the L level so that the transistors T1 and T2 are turned off. Therefore, the data lines X to which the data current Idata is supplied are electrically separated from the drain of the transistor T3 so that the gate of the transistor T3 is electrically separated from the drain of the transistor T3. In response to the accumulated charges of the capacitor C, the gate voltage Vg is continuously applied to the gate of the transistor T3. In synchronization with (not at the same timing) the transition of the scanning signal SEL to the L level at the timing t1, the driving signal GP that was previously at the L level rises to the H level. Therefore, from the power supply voltage Vdd to the reference voltage Vss, the path of the driving current Ioled that flows through the transistors T3 and T4 and the organic EL element OLED is formed. The driving current Ioled that flows through the organic EL element OLED corresponds to the channel current of the transistor T3 and the current level thereof is controlled by the gate voltage Vg caused by the accumulated charges of the capacitor C.

In the driving period t1 to t2, the transistor T3 functions as a driving transistor that supplies the driving current Ioled to the organic EL element OLED. The organic EL element OLED emits light with brightness in response to the driving current Ioled.

A scanning line driving circuit 3 and a data line driving circuit 4 control the display of the display unit 1 in cooperation with each other under the control of a control circuit (not shown). The scanning line driving circuit 3 mainly comprises a shift register and an output circuit and performs line-sequential scanning of outputting the scanning signal SEL to the scanning lines Yl to Yn and sequentially selecting the scanning lines Yl to Yn in a predetermined selection order. The scanning signal SEL obtains a binary signal level such as an H level or an L level so that the scanning line Y corresponding to a pixel row (a group of pixels in one horizontal line) in which data is to be written are set to the H level and the other scanning lines Y are set to the L level. In one vertical scanning period (IF), respective pixel rows can be sequentially selected in a predetermined selection order. The scanning line driving circuit 3 also outputs the driving signal GP (or the base signal thereof) for conductively controlling a transistor T4, illustrated in FIG. 2, other than the scanning signal SEL. The driving period, that is, the period in which the brightness of the organic EL element OLED included in the pixel 2 is set, is set by the driving signal GP.

Figure 4:
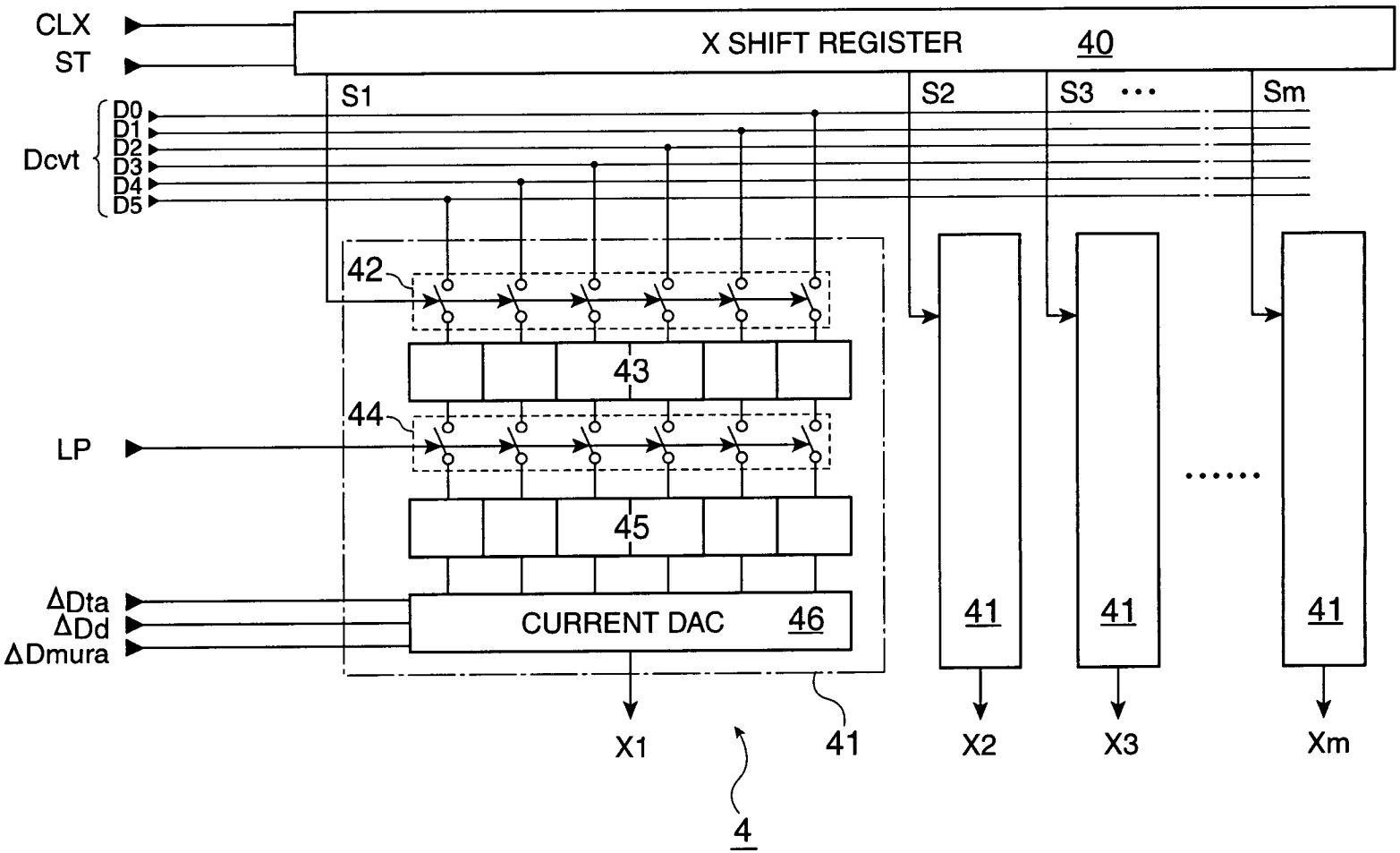
FIG. 4 is an exemplary a block diagram of a data line driving circuit.

The data line driving circuit 4 supplies signals to the respective data lines Xl to Xm on the basis of current in synchronization with line-sequential scanning using the scanning line driving circuit 3. FIG. 4 is an exemplary block diagram of the data line driving circuit 4. The data line driving circuit 4 consists of an X shift register 40 of m bits and m circuit units 41 provided in units of data lines. The X shift register 40 transmits the initially supplied start pulse ST of one horizontal scanning period (1H) in accordance with a clock signal CLX, and sequentially and exclusively sets the levels of latch signals S1, S2, S3, . . . , and Sm to the H level.

The m circuit units 41 simultaneously output the current-based signals to pixel rows in which data is written in a certain 1H and point sequentially latch data to pixel rows in which data is written in the next 1H. The single circuit unit 41 can include switch groups 42 and 44 that are a set of six switches provided in units of bits of data items Dcvt (D0 to D5), a first latch circuit 43, a second latch circuit 45, and a current DAC 46. The operation of each circuit unit 41 corresponding to each of the data lines Xl to Xm is the same for the fact that the congestion timings of the data items D0 to D5 by the latch signals S1, S2, S3, . . . , and Sm are different. That is, the top front switch group 42 is turned on when the corresponding latch signal S rises to the H level. Therefore, the six bit data items D0 to D5 are received to the first latch circuit 43 at the congestion timing defined by the latch signal S. The data items D0 to D5 latched to the first latch circuit 43 are transmitted to the second latch circuit 45 at the point in which a latch pulse LP rises to the H level so that the switch group 44 is turned on. At the same time, the data items D0 to D5 in the next 1H are newly latched to the first latch circuit 43 through the switch group 42.

The current DAC 46 digital-to-analog (D/A) converts the digital data items D0 to D5 of six bits latched to the second latch circuit 45, generates the data current Idata that is an analog signal, and supplies the data current Idata to the corresponding data lines X. The current DAC 46 functions as a pixel-driving unit that is a part of the later-mentioned correction circuit. A circuit required for driving pixels is added to the current DAC 46. However, the specific circuit structure of the current DAC 46 will be mentioned later.

Also, the present invention can be applied to a structure in which data items are directly and linear sequentially input to the data line driving circuit 4 from a frame memory (not shown). However, in this case, the operations of the portions that mainly constitute the present invention are the same. In such a structure, it is not necessary to provide a shift register in the data line driving circuit 4.

In the embodiment, a correction circuit having circuit elements 5 to 10 and the additional circuit of the current DAC 46 is provided. A plurality of disturbance factors is integrally corrected using the correction circuit. There are five disturbance factors to be corrected. The correction factors for correcting the disturbance factors are ΔDta, ΔDtl, ΔDlx, ΔDd, and ΔDmura.

The ambient temperature change ΔDta is the correction component for correcting the changes in the temperature of the use environment of an electro-optical device, that is, the ambient temperature Ta. In general, when the ambient temperature Ta changes, the driving voltage and the luminous efficiency of the organic EL element OLED change. Therefore, in order to stabilize the display quality in the entire temperature region, it is preferable to perform correction with consideration to the influence of the ambient temperature Ta that is the disturbance factor.

Figure 5:
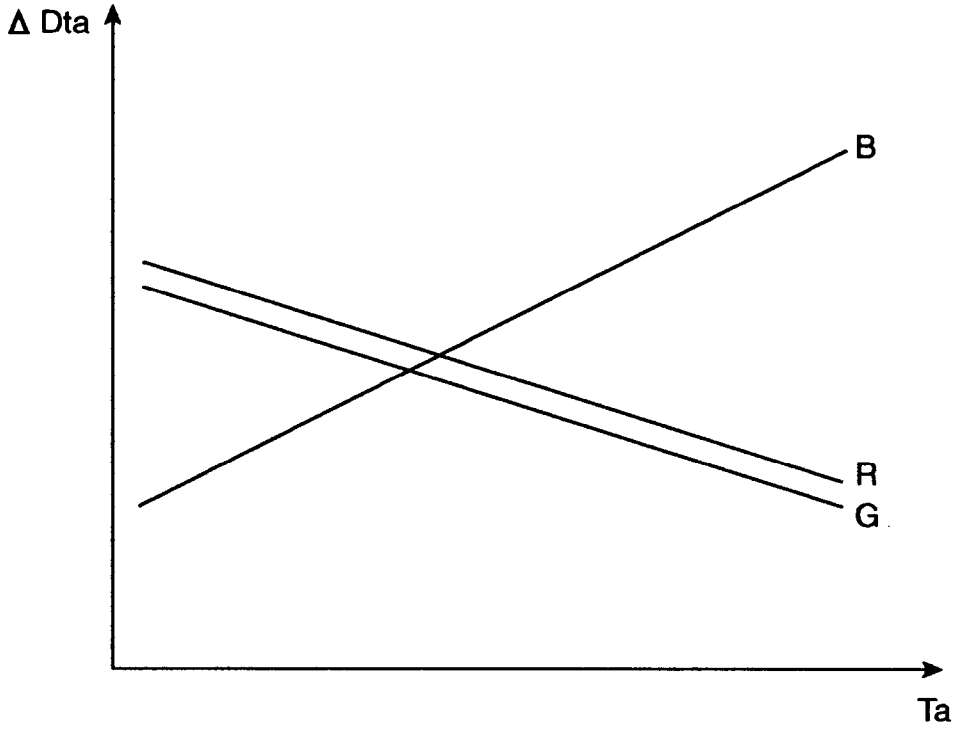
FIG. 5 is a view illustrating the relationship between the ambient temperature Ta and the ambient temperature change ΔDta.

FIG. 5 is a view illustrating the relationship between the ambient temperature Ta and the ambient temperature change ΔDta, as an example. Considering that the temperature-brightness characteristics of the organic EL element OLED of RGB are different from each other, the ambient temperature change ΔDta is set in each of the RGB. In the B (Blue), the ambient temperature change ΔDta linearly increases with a rise in the ambient temperature Ta. In the R (Red) and G (green), the ambient temperature change ΔDta is linearly reduced in accordance with a rise in the ambient temperature Ta.

Correction in response to the ambient temperature change ΔDta is performed in real time by detecting the ambient temperature Ta around the display unit 1 by a temperature-detecting unit 6 provided as a built-in sensor of the electro-optical device. An operation unit 8 performs an operation using the ambient temperature Ta detected by the temperature-detecting unit 6 as an input to calculate the correction value to be taken into account when the grayscales of the pixels 2 are set and outputs the correction value to the data line driving circuit 4 as the ambient temperature change ΔDta. A table referring process (a look-up table processing) for obtaining the output value ΔDta from the input value Ta with reference to a conversion table in which characteristics as illustrated in FIG. 5 are described, is used as such operation processing. However, other processing methods may be used. Also, the correction unit is the entire display unit 1 considering that the entire display unit 1 is affected by the ambient temperature Ta.

A semiconductor chip mounted with a temperature sensor may be used as the temperature-detecting unit 6 as disclosed, for example, in Japanese Unexamined Patent Application Publication No. 2002-98594. A temperature-detecting element (an element for detecting changes in voltage in accordance with the temperature of a PN junction) formed on the substrate of the display unit 1 may also be used as the temperature-detecting unit 6 as disclosed, for example, in Japanese Unexamined Patent Application Publication No. 2002-122838.

In order to secure the degree of detection precision of the ambient temperature Ta, it is preferable that the ambient temperature of the display unit 1 not be unevenly distributed. Therefore, it is preferable that the heat generated by the electro-optical device be effectively radiated and the ambient temperature be made uniform using a cooling fan or a high thermal conductive material, as disclosed, for example, in Japanese Unexamined Patent Application Publication Nos. 11-95872 and 11-251777.

Figure 6:
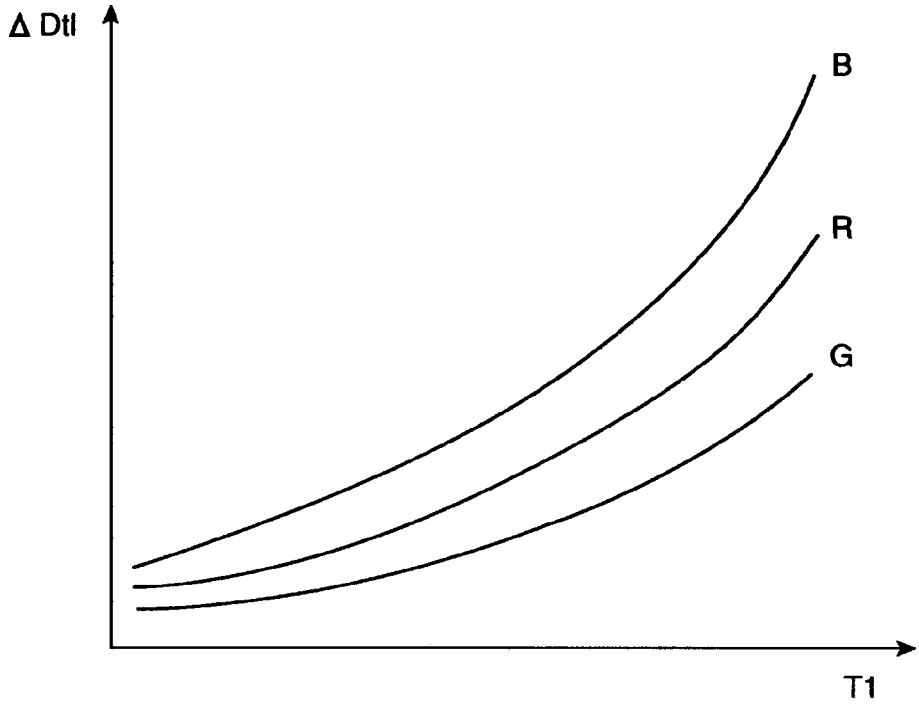
FIG. 6 is a view illustrating the relationship between the heat generation temperature Tl and the self-heating temperature change ΔDtl.

The self-heating temperature change ΔDtl is the correction factor for correcting changes in the heat generation temperature Tl accompanied by the luminescence of the organic EL element OLED. In general, as the luminescence brightness of the organic EL element OLED improves, the heat generation temperature of the organic EL element OLED rises. Therefore, in order to stabilize the display quality in the entire heat generation temperature region, it is preferable to perform correction with consideration to the influence of the heat generation temperature Tl that is the disturbance factor. FIG. 6 is a view illustrating the relationship between the heat generation temperature Tl and the self-heating temperature change ΔDtl, as an example. The self-heating temperature change ΔDtl is set in each of the RGB. However, any self-heating temperature change ΔDtl non-linearly increases with a rise in the heat generation temperature Tl.

The relationship between the grayscales of the pixels 2 and the heat generation temperature Tl is already known through experiments and simulations. On the basis of that knowledge, the self-heating temperature change ΔDtl is inserted as the set value of the conversion table included in a grayscale characteristic generating unit 9. That is, the contents of the conversion table include the characteristics as illustrated in FIG. 6. In this case, it is not necessary to use sensors in order to perform correction in response to the self-heating temperature change ΔDtl. Also, a correction unit is basically each pixel. However, when it is assumed that the heat generation amount of a certain pixel 2 is diffused into peripheral pixels, the correction unit may be a block including the peripheral pixels.

Figure 7:
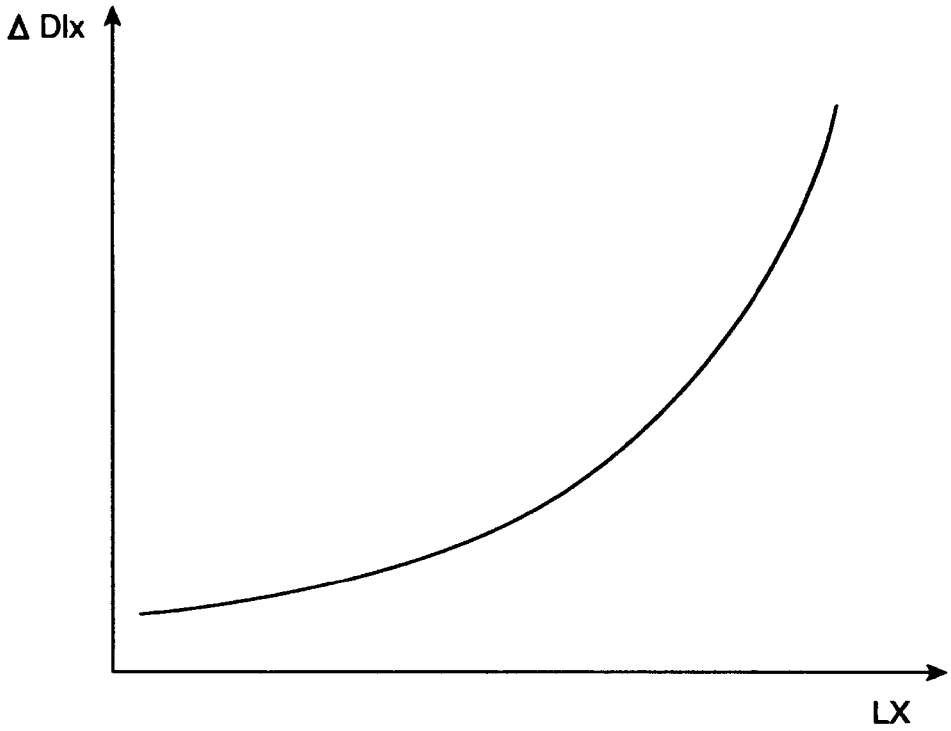
FIG. 7 is a view illustrating the relationship between the ambient illuminance Lx and the ambient illuminance change ΔDlx.

The ambient illuminance change ΔDlx is the correction factor for correcting the brightness of the use environment of the electro-optical device, that is, changes in the ambient illuminance Lx. In general, in accordance with the degree of external light, the luminescence brightness of the organic EL element OLED, which is optimal for decently displaying external shapes, changes. For example, when the electro-optical device is used under bright external light, it is possible to improve visibility by increasing luminescence brightness and contrast, as compared with a common display state. On the other hand, when the electro-optical device is used indoors, that is, in a dark room, since it is too bright in the common display state, it is possible to improve visibility by reducing luminescence brightness. Therefore, in order to obtain stable visibility in the entire luminance region, it is preferable to perform correction with consideration to the influence of ambient illuminance Lx that is the disturbance factor. FIG. 7 is a view illustrating the relationship between the ambient illuminance Lx and the ambient illuminance change ΔDlx as an example. The ambient illuminance change ΔDlx is common in each of the RGB unlike the other correction factors and non-linearly increases with an increase in ambient illuminance Lx.

Correction in accordance with ambient illuminance change ΔDlx is performed in real time by detecting the ambient illuminance Lx around the display unit 1 by an illuminance-detecting unit 5 provided as a built-in sensor of the electro-optical device. The operation unit 8 performs an operation using the ambient illuminance Lx detected by the illuminance-detecting unit 5 as an input to calculate a correction value to be taken account when the grayscales of the pixels 2 are set, and outputs the correction value to the grayscale characteristic generating unit 9 as the ambient illuminance change ΔDlx. An LUT processing of obtaining the output value ΔDlx from the input value Lx, with reference to a conversion table whose characteristics as illustrated in FIG. 7 are described, is used as such operation processing. However, other processing methods may be used as the operation. Also, the correction unit is the entire display unit 1 considering that the display unit 1 is affected by the ambient illuminance Lx.

An illuminance sensor for detecting the intensity of external light may be used as the illuminance-detecting unit 5 as disclosed, for example, in Japanese Unexamined Patent Application Publication No. 2000-66624. Also, in order to secure the degree of detection precision of the ambient illuminance Lx, it is preferable to provide a structure for shielding luminescence in the display unit 1 so as not to be affected by the luminescence of the display unit 1.

Figure 8:
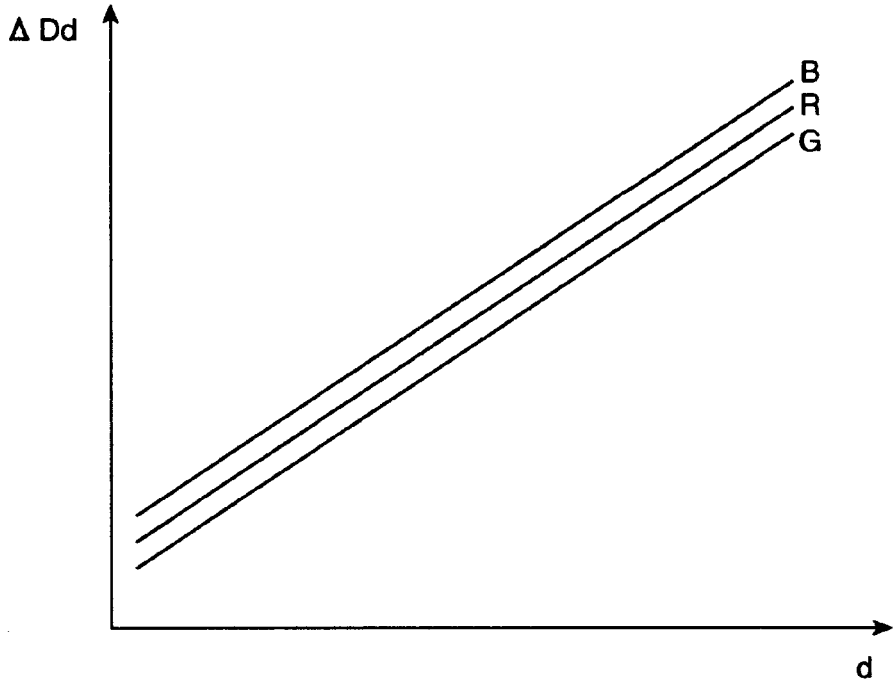
FIG. 8 is a view illustrating the relationship between the degree of deterioration d and the deterioration change ΔDd.

The deterioration change ΔDd is the correction factor for correcting changes caused by the degree of deterioration d of the organic EL element OLED. In general, as the organic EL element OLED deteriorates, the driving voltage and the luminous efficiency of the organic EL element OLED deteriorate. Therefore, in order to stabilize the display quality in the entire temporal axis region, it is preferable to perform correction with consideration to the influence of the degree of deterioration d that is the disturbance factor. FIG. 8 is a view illustrating the relationship between the degree of deterioration d and the deterioration change ΔDd, as an example. Considering that the degree of deterioration d in the RGB is different from each other, the deterioration change ΔDd is set in each of the RGB. However, any deterioration change ΔDd linearly increases with an increase in the degree of deterioration d.

The correction in accordance with the deterioration change ΔDd is performed in real time by detecting the degree of deterioration d using a deterioration degree detecting unit 7 provided as a built-in sensor of the electro-optical device. The operation unit 8 performs an operation using the degree of deterioration d detected by the deterioration degree detecting unit 7 as an input to calculate the correction value to be taken into account when the grayscales of the pixels 2 are set and outputs the correction value to the data line driving circuit 4 as the deterioration change ΔDd. An LUT processing of obtaining the output value ΔDd from the input value d with reference to a conversion table in which characteristics as illustrated in FIG. 8 are described, is used as such operation processing. However, other processing methods may be used as the operation.

A timer for measuring the accumulated time for which the electro-optical device has operated and a counter for measuring the accumulated number of display data items accumulated in the frame memory may be used as the deterioration degree detecting unit 7. In this case, the correction unit is the entire display unit 1. Instead of a method of estimating the degree of deterioration d on the basis of the temporal axis, it is possible to estimate the degree of deterioration d on the basis of the emitting state of the organic EL element OLED. For example, the luminescence brightness of the organic EL element OLED is detected in units of pixels using a brightness sensor, such as a charge coupled device (CCD) sensor, or a CMOS sensor, and the degree of deterioration d is estimated from the amount by which the actual brightness deteriorates from the original brightness. In this case, the correction unit is each pixel.

The specific structures of such a brightness sensor may include a structure in which a cover capable of being opened and closed is provided in the electro-optical device and a CCD sensor is provided on the internal surface of the cover that faces the display unit 1, in addition to the structures disclosed, for example, in Japanese Unexamined Patent Application Publication No. 9-237887 or Japanese Unexamined Patent Application Publication No. 11-345957.

Figure 9:
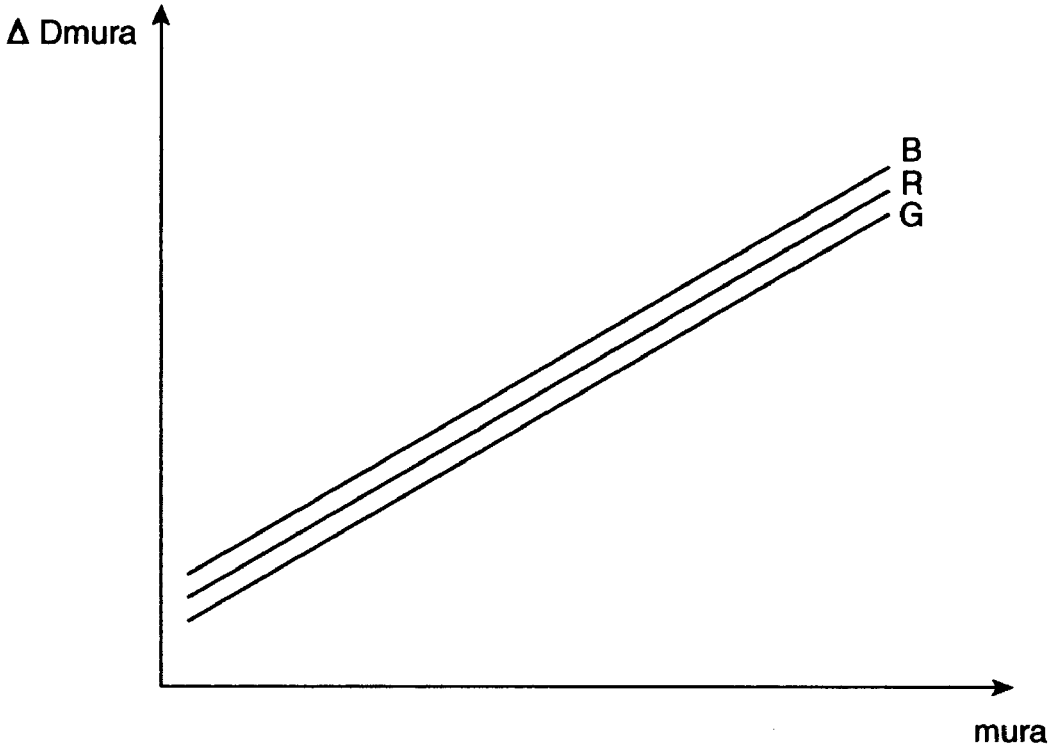
FIG. 9 is a view illustrating the relationship between the non-uniformity degree mura and the display non-uniformity ΔDmura.

The display non-uniformity ΔDmura is the correction factor for correcting the non-uniformity degree mura of the display unit 1 due to the difference in the driving voltages, the luminous efficiencies, and the chromaticities of the organic EL element OLED. FIG. 9 is a view illustrating the relationship between the non-uniformity degree mura and the display non-uniformity ΔDmura, as an example. With consideration to the difference in the characteristics of the RGB, the display non-uniformity ΔDmura is set in each of the RGB. However, any non-uniformity ΔDmura linearly increases with progress in the non-uniformity degree mura.

Correction in accordance with the display non-uniformity ΔDmura can be performed before discharging products by detecting the non-uniformity degree mura using a testing device (not shown) attached to the outside of the electro-optical device. The operation unit 8 performs an operation using the non-uniformity degree mura detected by the testing device as an input to calculate a correction value to be taken into account when the grayscales of the pixels 2 are set and outputs the correction value to the data line driving circuit 4 as the display non-uniformity ΔDmura. An LUT processing of obtaining the output value ΔDmura from the input value mura with reference to a conversion table in which characteristics as illustrated in FIG. 9 are described, is used as such operation processing. However, other processing methods may be used as the operation. When the non-uniformity degree mura is detected in units of pixels, the correction unit is each pixel.

It is enough to perform correction in accordance with the display non-uniformity ΔDmura before discharging products and it is not necessary to perform correction after discharging the products. However, it is possible to detect the non-uniformity degree mura using the above-mentioned brightness sensor in real time and to perform the correction in accordance with the display non-uniformity ΔDmura in real time.

Figures 10, 11:
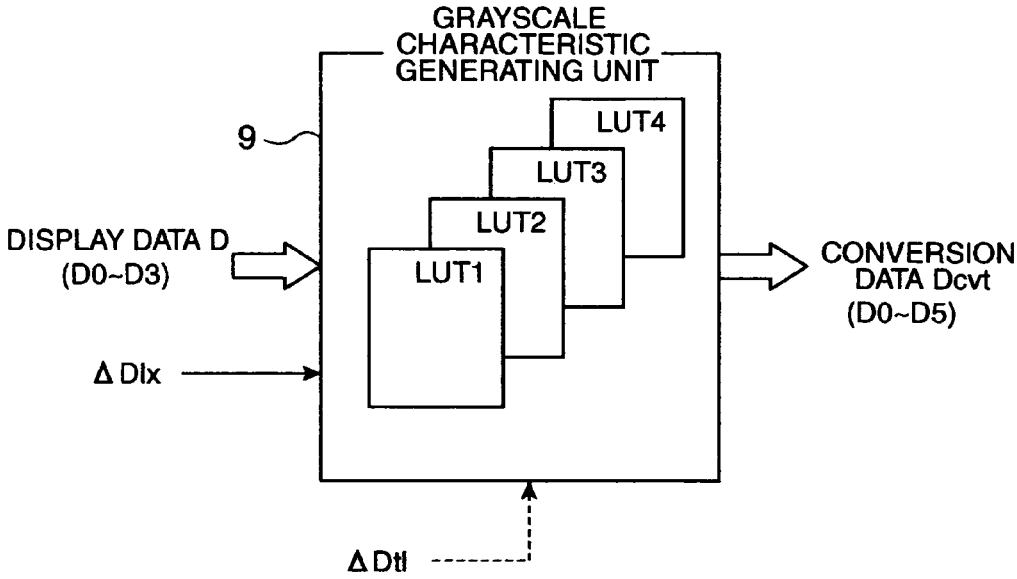
FIG. 10 is an exemplary block diagram of a grayscale characteristic generating unit.
FIG. 11 is a view illustrating a conversion table.

FIG. 10 is an exemplary block diagram of the grayscale characteristic generating unit 9. The grayscale characteristic generating unit 9 generates and outputs the conversion data Dcvt by roughly adjusting the grayscale characteristics of input display data D. Here, data conversion consisting of changing the form of the grayscale characteristics of the display data D into another form, such as data conversion (rough adjustment), that accompanies a large amount of change that cannot be easily performed in a logic operation is performed. Therefore, an LUT processing capable of being easily performed by rough adjustment is adopted. The display data D is a digital signal for defining the grayscales of the pixel 2 and, in general, is data from an upper frame memory (not shown). Most of display data D is linear for the grayscales. However, the grayscale characteristic generating unit 9 has a function of processing the display data D to a non-linear value. Therefore, it is necessary to provide a bit region larger than the bit region that the display data D has. In the present embodiment, the conversion data items Dcvt D0 to D5 of six bits are generated with respect to the display data items D D0 to D3 of four bits.

The grayscale characteristic generating unit 9 has a plurality of conversion tables LUT1 to LUT4 whose description contents are different from each other. FIG. 11 is a view illustrating the conversion tables LUT1 to LUT4.

Figure 12:
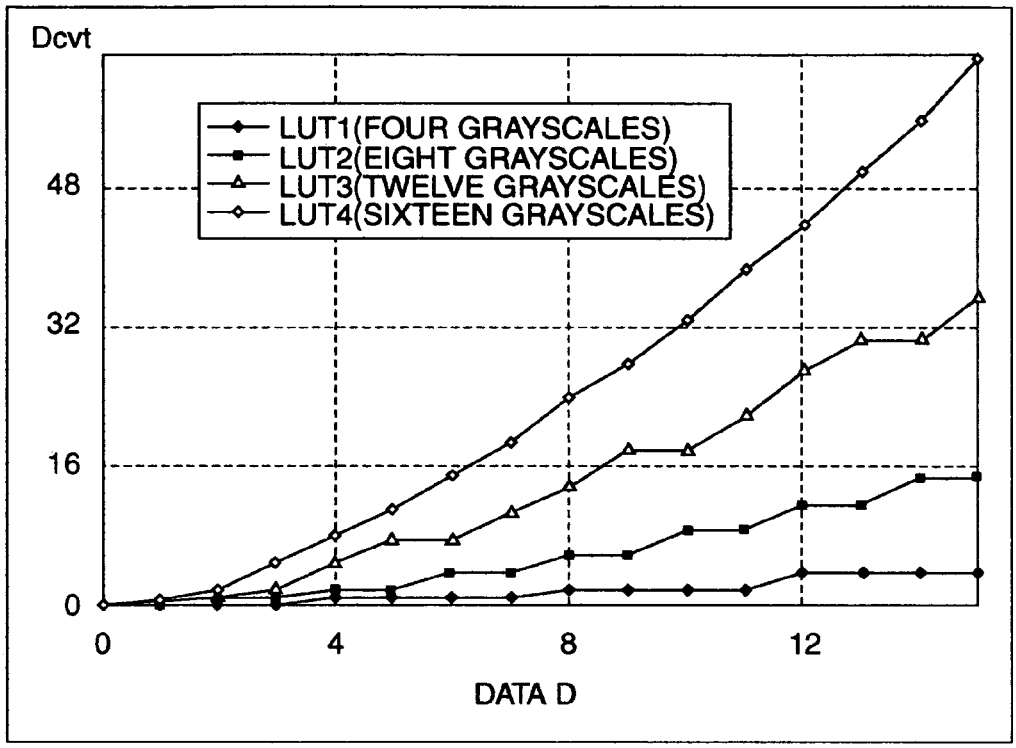
FIG. 12 is a view illustrating the grayscale characteristics of the conversion data.

FIG. 12 is a view illustrating the grayscale characteristics of the conversion data Dcvt generated by converting the display data D. The horizontal axis and the vertical axis denote the display data D and the conversion data Dcvt, respectively. In the respective conversion tables LUT1 to LUT4, a correspondence relationship between the display data D (input values) of four bits and the conversion data Dcvt (output values) of six bits is described. Unlike the grayscale characteristics of the display data D, in the grayscale characteristics of the conversion data Dcvt, the linearity of the display data D is converted into non-linearity. Therefore, as the display data D has higher grayscales, the conversion data Dcvt non-linearly increases.

Correction in accordance with the ambient illuminance change ΔDlx is realized by selecting one of the conversion tables LUT1 to LUT4. According to the characteristics of the conversion tables LUT1 to LUT4, the increase ratio of the conversion data Dcvt sequentially increases in the order of LUT1, LUT2, LUT3, and LUT4. The conversion data Dcvt for the same display data D tends to be shifted to higher grayscales in the order of LUT1, LUT2, LUT3, and LUT4. This tendency is more significant as the display data D has higher grayscales. The description contents of the conversion tables LUT1 to LUT4 include the influence of the ambient illuminance change ΔDlx.

As an example, in a first use environment, such as a dark room, the operation unit 8 commands that ΔDlx=0 so as to select the conversion table LUT1. Conversion data Dcvt corresponding to the display data D is output according to the description content of the conversion table LUT1. For example, when the display data D is "1000" (grayscale 8), the conversion data Dcvt of "000010" (grayscale 2) is output. According to the data conversion, the display data D is equivalent to that obtained when dark correction of significantly deteriorating original grayscales is performed. In a second use environment slightly brighter than the first use environment (for example in a bright room), the operation unit 8 commands that ΔDlx=1 so as to select the conversion table LUT2. As a result, the conversion data Dcvt in accordance with the contents of the conversion table LUT2 is output. For example, the conversion data Dcvt of "000110" (grayscales 6) is output with respect to the display data D of "1000" (grayscale 8). According to data conversion, the display data D is equivalent to that obtained when dark correction of slightly deteriorating original grayscales is performed. According to a third use environment (for example, outside on a cloudy day) brighter than the second use environment, the operation unit 8 commands that ΔDlx=2, so as to select the conversion table LUT3 as a subject of reference. For example, the conversion data Dcvt of "001110" (grayscale 14) is output with respect to the display data D of "1000" (grayscale 8). According to the data conversion, the display data D is equivalent to that obtained when dark correction of slightly improving the original grayscales is performed. Furthermore, according to a fourth use environment (for example, outside under bright external light) brighter than the third use environment, the operation unit 8 commands that ΔDlx=3 so as to select the conversion table LUT4 as a subject of reference. For example, the conversion data Dcvt of "011000" (grayscale 24) is output with respect to the display data D of "1000" (grayscale 8). According to the data conversion, the display data D is equivalent to that obtained when bright correction for significantly improving the original grayscales is performed.

Figure 13:
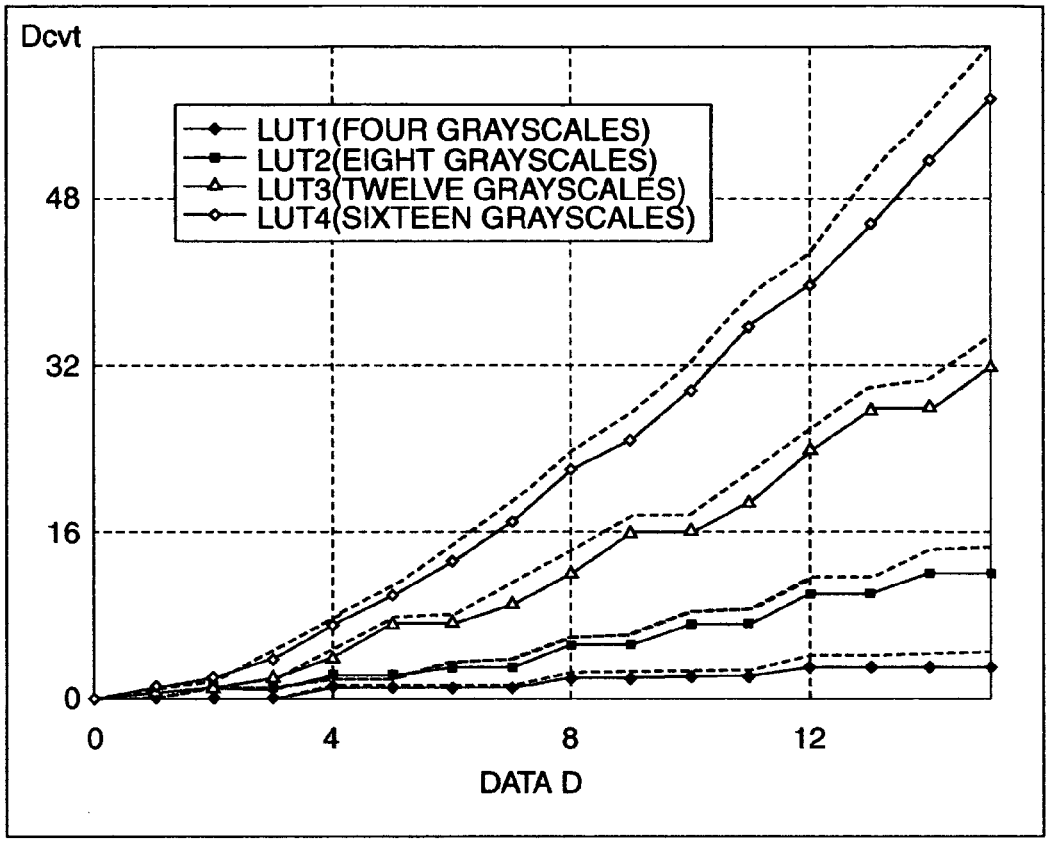
FIG. 13 is a view illustrating the deterioration of the grayscales, which is accompanied by the heat generation of the organic EL element.

On the other hand, the description contents of the conversion tables LUT1 to LUT4 include the self-heating temperature change ΔDtl as well as the ambient illuminance change ΔDlx. In general, it is known that the organic EL element OLED generates heat in addition to luminescence to thus deteriorate the luminous efficiency. Therefore, as illustrated in FIG. 13, the actual grayscales (the grayscale characteristics as externally shown) marked with solid lines are lower than the original grayscales marked with the dotted lines. Therefore, the contents of the conversion tables LUT1 to LUT4 are set after estimating such grayscale deviation. As a result, the data in which the grayscale deviation accompanied by heat generation of the organic EL element OLED is corrected is output as conversion data Dcvt.

Figure 14:
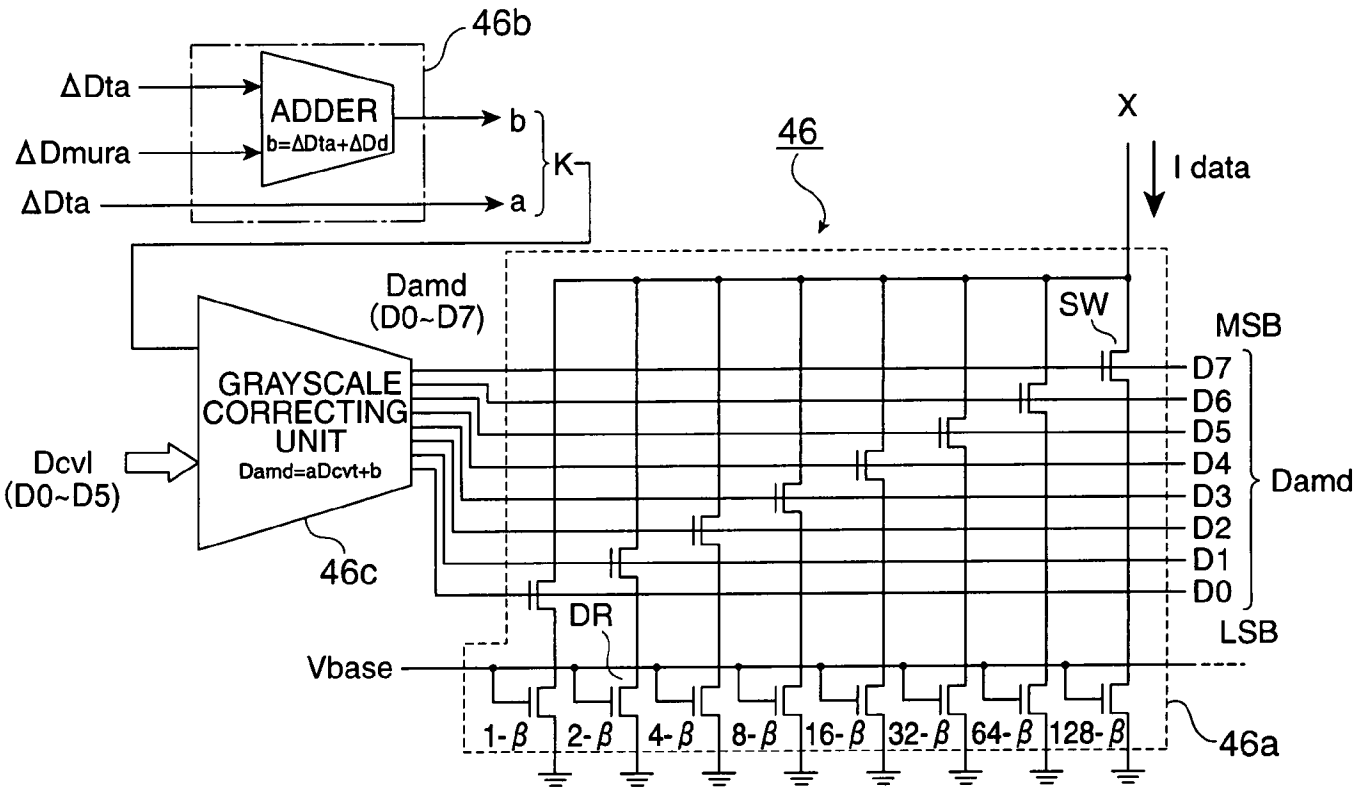
FIG. 14 is an exemplary block diagram of a current DAC according to a first embodiment.

FIG. 14 is an exemplary block diagram of the current DAC 46 according to the embodiment of the invention. The current DAC 46 can include a data signal generating unit 46*a* for generating the data signal supplied to the pixel 2 on the basis of a current as a main body, and a correction value generating unit 46*b* and a grayscale correcting unit 46*c* in addition to the data signal generating unit 46*a*. The correction value generating unit 46*b* comprises operating circuits for performing simple operations of addition, subtraction, multiplication, and division and, on the basis of the three correction factors ΔDta, ΔDd, and ΔDmura from the operation unit 8, generates a correction value K (a set of correction coefficients a and b) as a representative value obtained by integrating the correction factors ΔDta, ΔDd, and ΔDmura. As illustrated in FIG. 14, the value of the ambient temperature change ΔDta is the corrected coefficient a. The value obtained by adding the deterioration change ΔDd to the display non-uniformity ΔDmura is the corrected coefficient b. Also, the correction value K(a,b) is calculated using logic operations having a relatively simple degree of combinations of addition, subtraction, multiplication, and division; however, the correction value K(a,b) can be calculated using complicated logic operations.

Figure 16:
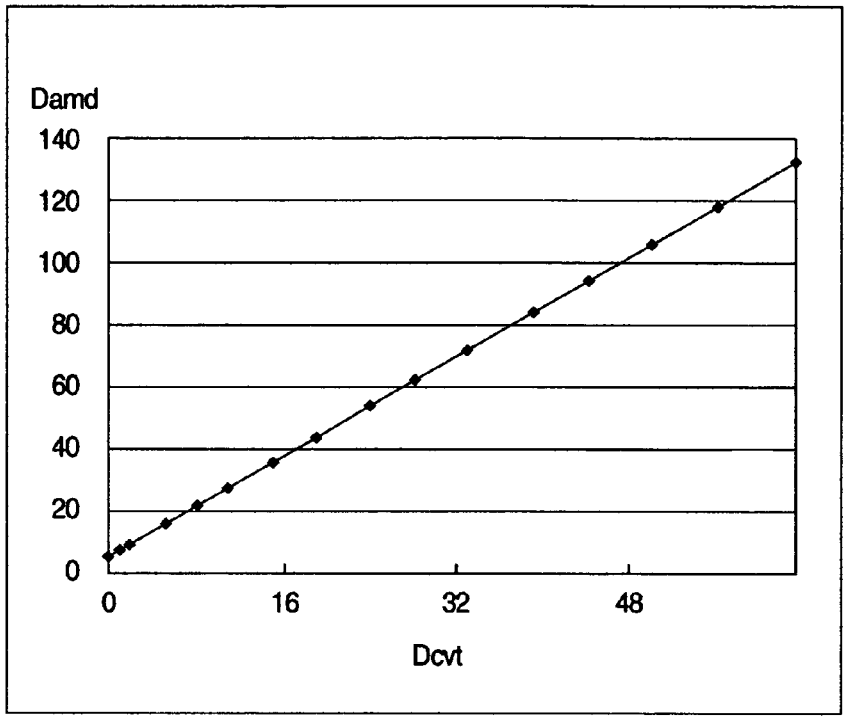
FIG. 16 is a view illustrating the characteristics of the data correction by a grayscale correcting unit.

The grayscale correcting unit 46*c* performs a predetermined operation on the conversion data Dcvt output from the grayscale characteristic generating unit 9 on the basis of the correction value K(a, b) to output correction data Damd. Here, the grayscale characteristics of the conversion data Dcvt are not significantly changed but predetermined correction processing is performed in one lump on the overall grayscales. The correction processing is the logic operations having a relatively simple degree of combinations of addition, subtraction, multiplication, and division, however, may be complicated logic operations. As a result, fine adjustment of correcting the grayscale characteristics on a level finer than the changes in the grayscale characteristics using the grayscale characteristic generating unit 9 while maintaining the basic grayscale characteristics of the conversion data Dcvt is performed. In the present embodiment, the conversion data Dcvt of six bits are enlarged by a linear operation of Damd=a·Dcvt+b to thus calculate the correction data Damd of eight bits. FIG. 15 is a view illustrating the relationship between the conversion data Dcvt (the input values) and the correction data Damd (the output values) when a=010 and b=110, as an example. FIG. 16 is a view illustrating the characteristics of the data correction by the grayscale correcting unit 46*c*.

The data signal generating unit 46*a* is provided between the data lines X and the reference voltage Vss and has pairs, each consisting of a switching transistor SW and a driving transistor DR serially connected to each other, by the number of bits of the correction data Damd (that is, eight). The respective driving transistors DR function as constant current sources that transmit current in accordance with the gain coefficient β thereof to channels. A predetermined driving voltage Vbase is commonly applied to the gates of the driving transistors DR. The ratio of the gain coefficients β of the driving transistors DR is set to 1:2:4:8:16:32:64:128 corresponding to the weight of eight bits that constitute the correction data Damd. The conduction state of the eight switching transistors SW is set in accordance with the contents of the correction data items Damd D0 to D7 of eight bits. In the driving transistor DR corresponding to the conducted switching transistor SW, the channel current in accordance with the gain coefficient β is generated. A data current Idata supplied to the data lines X is the value obtained by adding the values of the channel currents that flow through the respective driving transistors DR.

Figure 17:
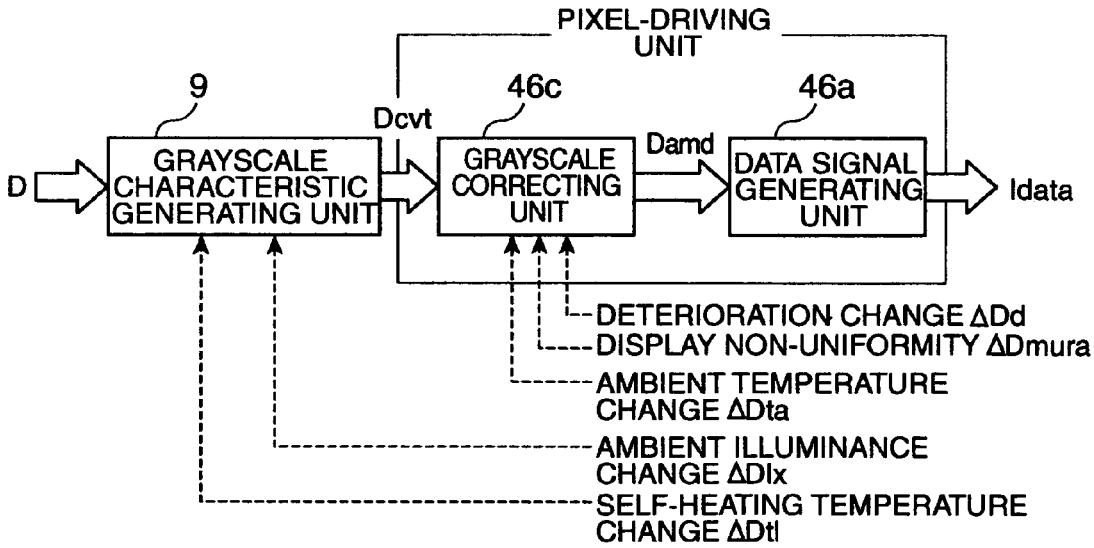
FIG. 17 is a view illustrating the rough characteristics of the first embodiment.

As mentioned above, according to the invention, it is possible to integrally perform correction corresponding to the plurality of disturbance factors. As illustrated in FIG. 17, in the embodiment, in the process of generating the data current Idata from the display data D, two different kinds of correction processing is performed. First, the grayscale-generating unit 9 performs correction in which the two correction factors ΔDlx and ΔDtl are taken into account by the LUT processing to thus generate conversion data Dcvt from display data D. The influences of the two disturbance factors, that is, the ambient illuminance Lx and the heat generation temperature Tl, are effectively reduced by correction based on the LUT processing to thus output the conversion data Dcvt having the grayscale characteristics obtained by changing the grayscale characteristics of the display data D.

The grayscale correcting unit 46*c* that constitutes a part of the pixel-driving unit performs correction in which the three correction factors ΔDd, ΔDmura, and ΔDta are taken into account by logic operation to thus generate correction data Damd from the conversion data Dcvt. The influences of the three disturbance factors, that is, the degree of deterioration d, the non-uniformity degree mura, and the ambient temperature Ta are effectively reduced by the correction based on the logic operations to thus output the correction data Damd obtained by correcting the grayscale characteristics of the conversion data. The data signal generating unit 46*a* that constitutes a part of the pixel-driving unit generates the data current Idata from the correction data Damd to thus drive the pixels 2 on the basis of the data current Idata. As mentioned above, it is possible to effectively reduce the influences of the plurality of disturbance factors by generating the data current Idata after integrally taking the five correction factors ΔDlx, ΔDtl, ΔDd, ΔDmura, and ΔDta into account, and it is possible to stabilize display quality.

According to the embodiment of the present invention, it is possible to perform a series of correction processing on the display data D at high speed using the rough adjustment by the LUT processing and the fine adjustment by the logic operations. In general, the LUT processing is appropriate to rough adjustment of significantly changing the grayscale characteristics. On the other hand, the description contents of the conversion tables LUT significantly increase with an increase in the number of inputs to thus easily deteriorate the processing speed. To the contrary, the logic operations are not appropriate to rough adjustment. On the other hand, the high-speed processing can be performed regardless of the number of inputs. Therefore, in the embodiment, the corresponding correction factors are divided into the rough adjustment factors ΔDlx and ΔDtl corresponding to the rough adjustment of changing the grayscale characteristics and the fine adjustment factors ΔDd, ΔDmura, and ΔDta corresponding to the change in levels which is finer than the rough adjustment. The former corresponds to rough adjustment using the LUT processing. The latter corresponds to the fine adjustment of levels, which is finer than the rough adjustment. Therefore, it is possible to significantly reduce the description contents of the conversion tables LUT compared with a case in which all of the correction factors correspond to the LUT processing. As a result, it is possible to increase the speed of the series of correction processing performed on the display data D, and it is possible to perform the correction processing in the real time.

Furthermore, in the embodiment, the characteristics of the self-heating temperature change ΔDtl are previously obtained by experiments and simulations to thus write the conversion tables LUT whose description contents include the characteristics of self-heating temperature change ΔDtl. The conversion data Dcvt is generated from the display data D with reference to the conversion tables LUT. Therefore, it is not necessary to directly detect the heat generation temperature during the luminescence of the organic EL element OLED by a temperature sensor. As a result, it can be possible to suppress an increase in the scale of the circuits of the display unit 1 and to solve problems with regard to the degree of detection precision of the sensor.

Also, in the embodiment, both the ambient illuminance change ΔDlx and the self-heating temperature change ΔDtl are the fine adjustment factors. However, the ambient illuminance change ΔDlx or the self-heating temperature change ΔDtl may be the fine adjustment factor. Similarly, the ambient temperature change ΔDta, the deterioration change ΔDd, and the display non-uniformity ΔDmura are the rough adjustment factors. However, the ambient temperature change ΔDta and/or the deterioration change ΔDd and/or the display non-uniformity ΔDmura may be the rough adjustment factor. Also, the present invention can be widely applied to the correction processing with consideration to the correction factors excluding the five correction factors.

Also, in the embodiment, in order to integrate the plurality of fine adjustment factors ΔDd, ΔDmura, and ΔDta, the correction value generating unit 46*b* for calculating the correction value K as the representative value of the fine adjustment factors ΔDd, ΔDmura, and ΔDta is provided. Therefore, when only one fine adjustment factor is provided, the correction value generating unit 46*b* may not be provided.

Furthermore, it should be understood that the structure of the pixel circuits to which the invention can be applied is not limited to the above-mentioned embodiments but includes the structure of the pixel circuits, as disclosed in Japanese Unexamined Patent Application Publication No. 2002-51430. The invention is not limited to the pixel circuits of a current program method but can be applied to the pixel circuits using a voltage program method in which the output of data to the data lines X is performed on the basis of a voltage.

The above-mentioned three modifications correspond to the following second and third embodiments.

Figure 18:
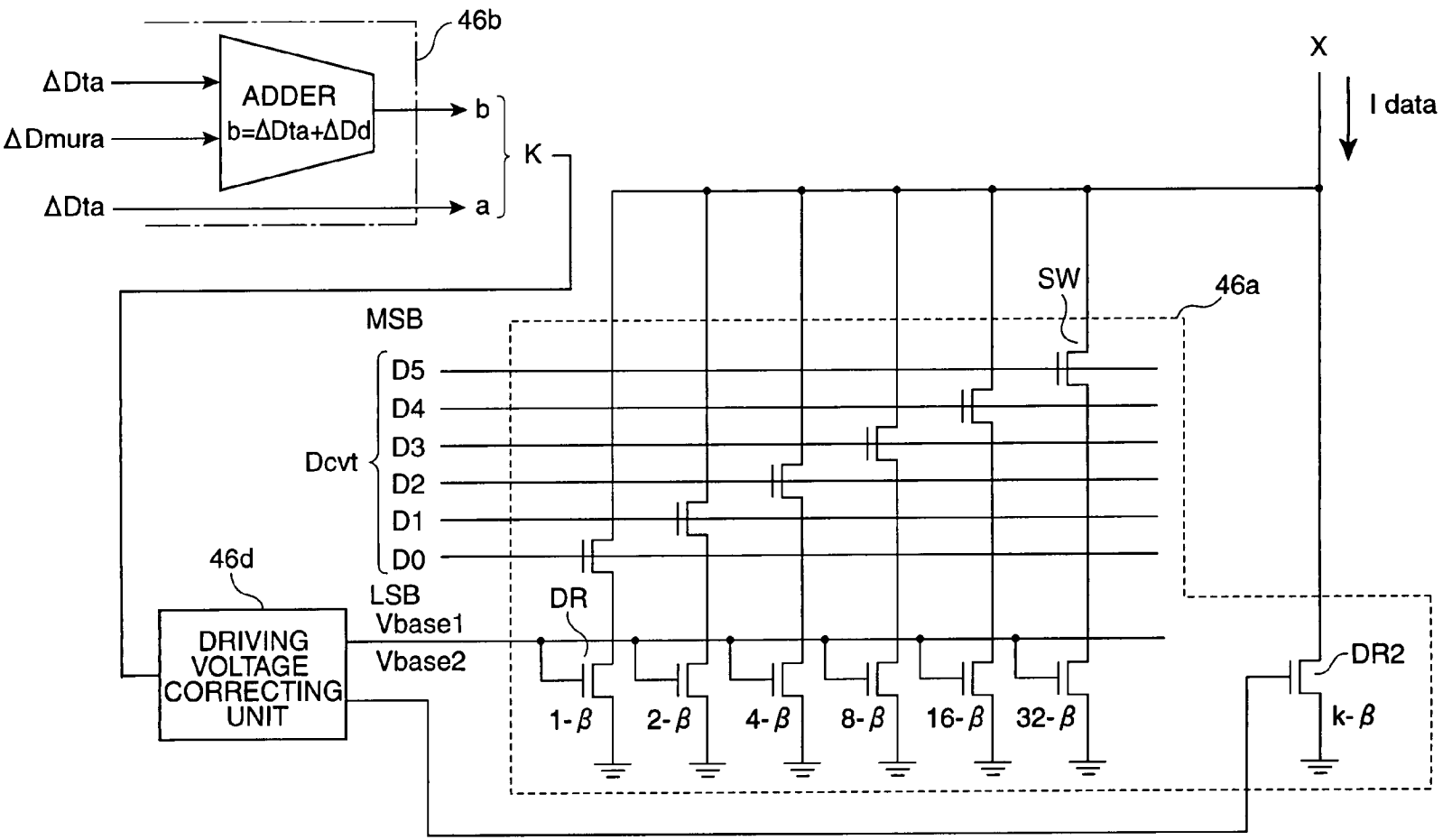
FIG. 18 is a block diagram of the current DAC according to a second embodiment.

FIG. 18 is an exemplary block diagram of the current DAC 46 according to the second embodiment. The current DAC 46 includes a data signal generating unit 46*a* for generating the data signal supplied to the pixel 2 on the basis of a current as a main body, the correction value generating unit 46*b*, and the driving voltage correcting unit 46*d*, in addition to the data signal generating unit 46*a*. The structure of FIG. 18 is different from that of FIG. 14 in the structure of the data signal generating unit 46*a* and in that the driving voltage correcting unit 46*d* is provided instead of the grayscale correcting unit 46*c*. Since the structure of the circuit elements of FIG. 18 is the same as that of the circuit elements of FIG. 14, excluding the above-mentioned differences, the circuit elements of FIG. 18 will be denoted by the same reference numerals as those of FIG. 14, and description thereof will be omitted.

The data signal generating unit 46*a* can be provided between the data lines X and the reference voltage Vss and has pairs, each consisting of a switching transistor SW and a driving transistor DR serially connected to each other, by the number of bits of the conversion data Dcvt (that is, six). The ratio of the gain coefficients β of the six driving transistors DR is set to 1:2:4:8:16:32, corresponding to the weight of six bits that constitute the conversion data Dcvt. The first driving voltage Vbase1 is commonly applied to the gates of the driving transistors DR. The conduction state of the six switching transistors SW is set in accordance with the contents of the conversion data items Dcvt D0 to D5 from the grayscale characteristic generating unit 9. In the driving transistor DR corresponding to the conducted switching transistor SW, the channel current in accordance with the gain coefficient β is generated. Furthermore, a driving transistor DR2 having the gain coefficient k·β (k is a natural number) is added between the data lines X and the reference voltage Vss. A second driving voltage Vbase2 is applied to the gate of the driving transistor DR2.

The driving voltage correcting unit 46*d* variably sets the first driving voltage Vbase1 and the second driving voltage Vbase2 on the basis of the correction value K(a, b) from the correction value generating unit 46*b*. The first driving voltage Vbase1 is set in accordance with the correction coefficient a and the value thereof increases with the increase in the correction coefficient a. The second driving voltage Vbase2 is set in accordance with the correction coefficient b and the value thereof increases in accordance With an increase in the correction coefficient b. The channel currents of the driving transistors DR and DR2 are finely controlled by the driving voltages Vbase1 and Vbase2. As a result, the data current Idata is analog corrected.

Figure 19:
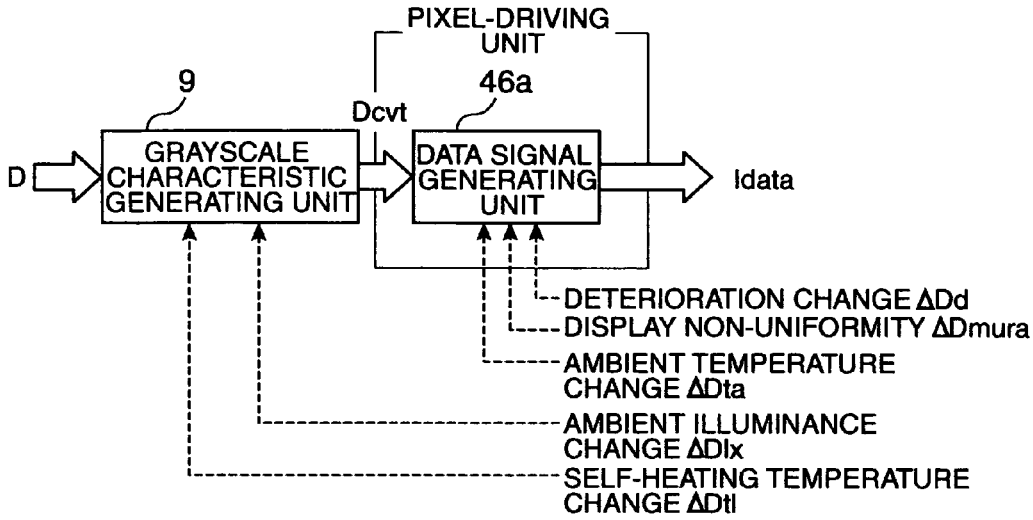
FIG. 19 is a view illustrating the rough characteristics of the second embodiment.

FIG. 19 illustrates schematic characteristics of the present embodiment. In the embodiment, in the process of generating data current Idata from the display data D, two different kinds of correction processing is performed. First, the grayscale characteristic generating unit 9 performs correction by the LUT processing in which the two correction factors ΔDlx and ΔDtl are taken into account to thus generate conversion data Dcvt from the display data D. The data signal generating unit 46*a* corresponding to the pixel-driving unit generates the data current Idata from the conversion data Dcvt. Since the channel currents of the driving transistors DR and DR2 change in accordance with the three correction factors ΔDd, ΔDmura, and ΔDta, the data current Idata is finely analog controlled. The pixels 2 are driven by the analog corrected data current Idata.

It is possible to reduce the influences of the plurality of disturbance factors by generating data current Idata after integrally taking into account the five correction factors ΔDlx, ΔDtl, ΔDd, ΔDmura, and ΔDta and to stabilize the display quality. It is also possible to perform a series of correction processing on the display data D at high speed using the rough adjustment by the LUT processing and the fine adjustment by the analog processing.

Figure 20:
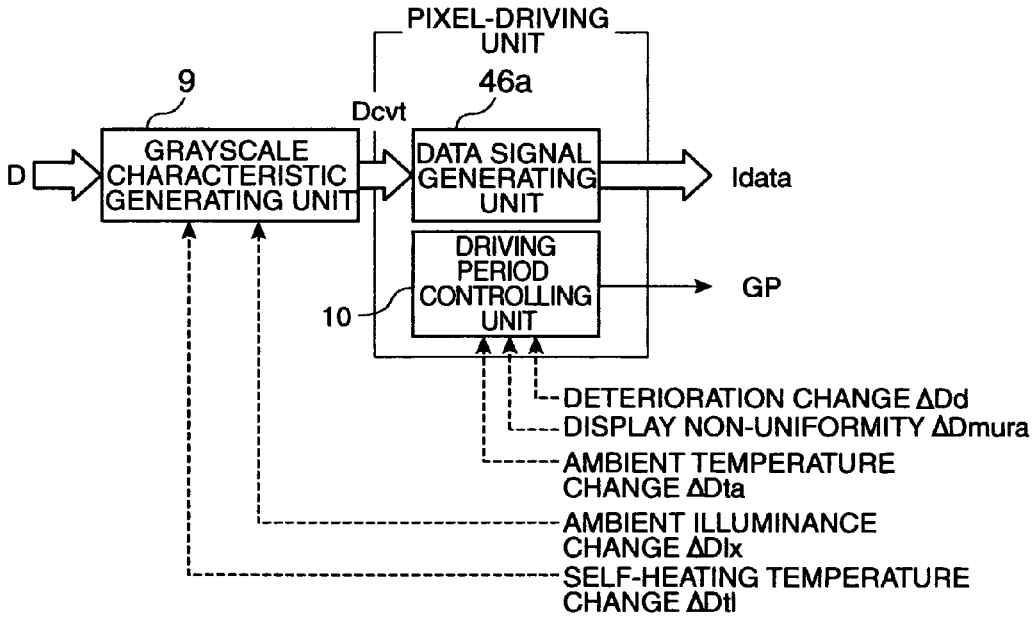
FIG. 20 is a view illustrating the rough characteristics of a third embodiment.

FIG. 20 is a view illustrating the schematic characteristics of a third embodiment. In the embodiment, correction in which the two correction factors ΔDlx and ΔDtl are taken into account is performed by the LUT processing of the grayscale characteristic generating unit 9 to thus generate conversion data Dcvt from the display data D. The data signal generating unit 46*a* that constitutes a part of the pixel-driving unit directly generates the data current Idata from the conversion data Dcvt without considering the three correction factors ΔDd, ΔDmura, and ΔDta and supplies the data current Idata to the pixels 2 through the data lines X.

Figure 21:
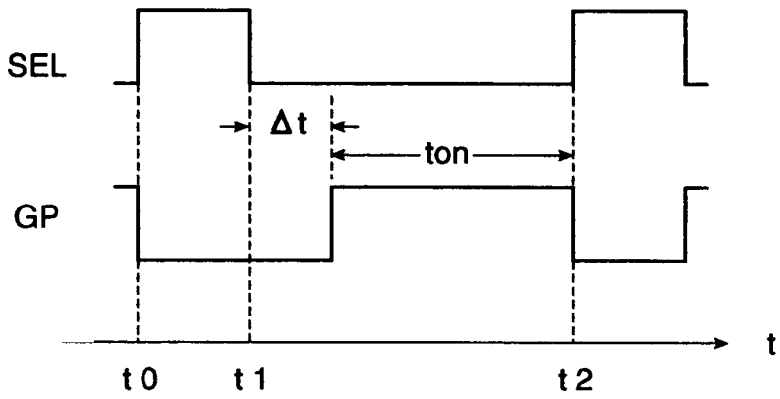
FIG. 21 is a driving timing chart of a pixel according to the third embodiment.
Figure 22:
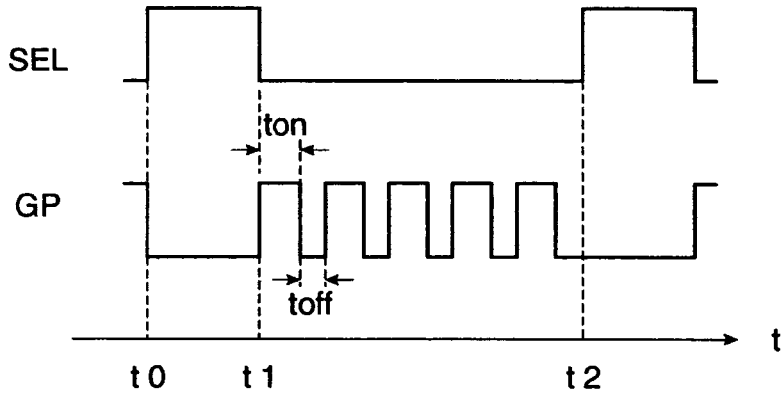
FIG. 22 is a driving timing chart of a pixel according to the third embodiment.

On the other hand, a driving period controlling unit 10 that constitutes a part of the pixel-driving unit controls the driving period of the pixel 2 illustrated in FIG. 2 after considering the three correction factors ΔDd, ΔDmura, and ΔDta. FIG. 21 is a driving timing chart of the pixel 2, as an example. Delay time At is set between the falling timing t1 of the scanning signal SEL and the rising timing of the driving signal GP, and is variably controlled by the correction value K(a, b). Therefore, the ON time ton in which the organic EL element OLED emits light is specified so as to determine the brightness of the organic EL element OLED. FIG. 22 is a driving timing chart of the pixel 2 as another example. In the period t1 to t2, the driving signal GP can be set in the form of a pulse, and the on period ton in which the organic EL element OLED emits light and the off period toff in which the organic EL element OLED does not emit light, are alternately set. The luminescence brightness of the organic EL element OLED is determined by the duty ratio of the on period ton that occupies the period t2 to t3. Also, the driving period may be controlled by subfield driving that is a kind of a temporal axis modulating method. As widely known, in subfield driving, the grayscale display of the pixels is performed by the plurality of subfields defined by dividing a predetermined period (for example, one frame).

As mentioned above, in the embodiment, the data current Idata is generated after taking into account the two correction factors ΔDlx and ΔDtl, and the driving time of the pixels 2 is variably controlled, after taking into account the three correction factors ΔDd, ΔDmura, and ΔDta. Therefore, as in the above-mentioned embodiments, it is possible to reduce the influences of the plurality of disturbance factors and to stabilize the display quality. It is possible to perform a series of correction processing on the display data D at high speed using the rough adjustment by the LUT processing and the fine adjustment based on the driving time.

Also, according to the above-mentioned embodiments, an organic EL element OLED is used as an electro-optical element. However, the present invention is not limited thereto but can be widely applied to various electro-optical elements using liquid crystal (LC), an inorganic LED, a digital micromirror device (DMD), and fluorescence by plasma emission and electron emission.

Furthermore, the electro-optical device according to the above-mentioned embodiments can be broadly mounted in various electronic apparatuses, such as a television set, a projector, a viewer, a mobile telephone, a portable terminal, a portable game set, an electronic book, a video camera, a digital still camera, a car navigation, a car stereo, a mobile computer, a personal computer, a printer, a scanner, a POS, a fax machine with video player display function, an electronic information plate, and an operation panel of a machine tool or a transport vehicle. When the above-mentioned electro-optical devices are mounted in the electronic apparatuses, it is possible to further improve the product values and the buying values of the electronic apparatuses.

According to the invention, it is possible to stabilize the display quality of the electro-optical device by integrally correcting the plurality of disturbance factors. It is also possible to increase the speed of the correction processing using rough adjustment by the LUT processing and fine adjustment by other processing different from the LUT processing.

While this invention has been described in conjunction with the specific embodiments thereof, it is evident that many alternatives, modifications and variations will be apparent to those skilled in the art. Accordingly, preferred embodiments of the invention as set forth herein are intended to be illustrative, not limiting. There are changes that may be made without departing for the spirit and scope of the invention.

What is claimed is:

1. An electro-optical device, comprising:

a grayscale characteristic generating unit that generates conversion data having grayscale characteristics obtained by changing grayscale characteristics of display data according to a grayscale conversion table that corresponds to the relationship between input display data and output conversion data is described, and at least one first correction factor that is included in the conversion table contents; and a pixel-driving unit that drives the pixels after correcting the grayscale characteristics of the conversion data by second correction factors different from the first correction factor using processing that is different from that of the grayscale characteristic generating unit, the first correction factor including a self-heating temperature change of the electro-optical elements included in the pixels, the second correction factors including an ambient temperature change of the electro-optical device and a deterioration change of at least one of the electro-optical elements included in the pixels and a display non-uniformity of the display unit in which the pixels are arranged in a matrix.

2. The electro-optical device of claim 1, the pixel-driving unit correcting the grayscale characteristics of the conversion data on a level finer than changes in the grayscale characteristics of the display data by the grayscale characteristic generating unit.

3. An electro-optical device, comprising:

a grayscale characteristic generating unit that generates conversion data obtained by roughly adjusting grayscale characteristics of display data defining grayscales of pixels with reference to a conversion table which corresponds to the relationship between input display data and output conversion data is described and at least one first correction factor is included in the conversion table contents; and a pixel-driving unit that drives the pixels after finely adjusting the grayscale characteristics of the conversion data on a level finer than the rough adjustment on the basis of second correction factors being different from the first correction factor, the first correction factor including a self-heating temperature change of the electro-optical elements included in the pixels, the second correction factors including an ambient temperature change of the electro-optical device and a deterioration change of at least one of the electro-optical elements included in the pixels and a display non-uniformity of the display unit in which the pixels are arranged in a matrix.

4. The electro-optical device of claim 1, the grayscale characteristic generating unit including a plurality of the conversion tables whose description contents are different from each other, and selects any one of the plurality of conversion tables as a subject of reference in accordance with the first correction factor.

5. The electro-optical device of claim 3, the pixel-driving unit comprising:

a grayscale correcting unit that generates correction data by correcting the conversion data on the basis of the second correction factors; and a data signal generating unit that generates data signals supplied to the pixels on the basis of the correction data.

6. The electro-optical device of claim 5, the grayscale correcting unit generating the correction data by a logic operation between the conversion data and the second correction factors.

7. The electro-optical device of claim 3, the pixel-driving unit including a data signal generating unit that generates data signals supplied to the pixels on the basis of the conversion data, and the data signal generating unit analog correcting the data signals on the basis of the second correction factors.

8. The electro-optical device of claim 3, the pixel-driving unit comprising:

a data signal generating unit that generates data signals supplied to the pixels on the basis of the conversion data; and a driving period controlling unit that variably controls a driving period in which the brightness of electro-optical elements included in the pixels is set on the basis of the second correction factors.

9. The electro-optical device of claim 5, the pixels including an electro-optical elements whose brightness is set by a current that flows through the pixels, and the data signal generating unit generating the data signals on the basis of current.

10. The electro-optical device of claim 1, further comprising an illuminance-detecting unit that detects the ambient illuminance of the electro-optical device, the ambient illuminance change being calculated on a basis of the ambient illuminance detected by the illuminance-detecting unit.

11. The electro-optical device of claim 3, further comprising a temperature-detecting unit that detects the ambient temperature of the electro-optical device, the ambient temperature change being calculated on the basis of the ambient temperature detected by the temperature-detecting unit.

12. The electro-optical device of claim 3, further comprising a deterioration degree detecting unit that detects a degree of deterioration of the electro-optical elements included in the pixels, the deterioration change being calculated on a basis of the degree of deterioration detected by the deterioration degree detecting unit.

13. The electro-optical device of claim 3, wherein the pixel-driving unit includes a correction value generating unit that calculates a correction value on a basis of the second correction factors and drives the pixels on a basis of the correction value calculated by the correction value generating unit.

14. The electro-optical device of claim 13, the correction value generating unit calculating the correction value by logic operations of the second correction factors.

15. An electronic apparatus in which the electro-optical device of claim 1 is mounted.

16. A method of driving an electro-optical device, comprising:

a first step of generating conversion data having grayscale characteristics obtained by changing grayscale characteristics of display data from display data defining grayscales of pixels with reference to a conversion table, which corresponds to the relationship between input display data and output conversion data is described, and at least one first correction factor is included in the conversion table contents; and a second step of driving the pixels after correcting the grayscale characteristics of the conversion data by second correction factors different from the first correction factor using processing different from that of the first step, the first correction factor comprising self-heating temperature change of the electro-optical elements included in the pixels, the second correction factors comprising an ambient temperature change of the electro-optical device and a deterioration change of at least one of the electro-optical elements included in the pixels and the display non-uniformity of the display unit in which the pixels are arranged in a matrix.

17. The method of driving the electro-optical device of claim 16, the second step further comprising correcting the grayscale characteristics of the conversion data on a level finer than changes in the grayscale characteristics of the display data in the first step.

18. A method of driving an electro-optical device, comprising:

a first step of generating conversion data obtained by roughly adjusting grayscale characteristics of display data defining the grayscales of pixels with reference to a conversion table, in which a correspondence relationship between input display data and output conversion data is described, and at least one first correction factor is included in the conversion table contents; and a second step of driving the pixels after finely adjusting the grayscale characteristics of the conversion data on a level finer than the rough adjustment on a basis of second correction factors being different from the first correction factor, the first correction factor comprising self-heating temperature change of the electro-optical elements included in the pixels, the second correction factors comprising an ambient temperature change of the electro-optical device and a deterioration change of at least one of the electro-optical elements included in the pixels and the display non-uniformity of the display unit in which the pixels are arranged in a matrix.

19. The method of driving the electro-optical device Of claim 16, the first step further comprising selecting any one of a plurality of the conversion tables whose description contents are different from each other as a subject of reference in accordance with the first correction factor.

20. The method of driving the electro-optical device of claim 16, the second step further comprising:

generating correction data by correcting the conversion data on a basis of the second correction factors; and generating data signals supplied to the pixels on the basis of a correction data.

21. The method of driving the electro-optical device of claim 20, generating the correction data being a step of generating the correction data by a logic operation between the conversion data and the second correction factors.

22. The method of driving the electro-optical device of claim 16, the second step further comprising generating data signals supplied to the pixels on the basis of a conversion data, and the data signals being analog corrected on the basis of the second correction factors in the step of generating the data signals.

23. The method of driving the electro-optical device of claim 16, the second step further comprising:

generating data signals supplied to the pixels on the basis of a conversion data; and variably controlling a driving period in which a brightness of the electro-optical elements included in the pixels is set on the basis of the second correction factors.

24. The method of driving the electro-optical device of claim 20, the pixels comprising electro-optical elements whose brightness is set by a current that flows through the electro-optical elements, and generating the data signals being a step of generating the data signals on the basis of current.

25. The method of driving the electro-optical device of claim 16, the ambient illuminance change being calculated on the basis of the ambient illuminance of the electro-optical device detected by an illuminance-detecting unit.

26. The method of driving the electro-optical device of claim 16, the ambient temperature change being calculated on the basis of the ambient temperature of the electro-optical device detected by a temperature-detecting unit.

27. The method of driving the electro-optical device of claim 16, the deterioration change being calculated on the basis of the degree of deterioration of the electro-optical elements included in the pixels detected by a deterioration degree detecting unit.

28. The method of driving the electro-optical device of claim 16, wherein the second step further comprises:

calculating a correction value on a basis of the second correction factors; and driving the pixels on a basis of the correction value.

29. The method of driving the electro-optical device of claim 28, the correction value being calculated by. logic operations of the second correction factors in the step of calculating the correction value.

* * * * *